US012214268B2

(12) United States Patent
Kulczycki et al.

(10) Patent No.: US 12,214,268 B2
(45) Date of Patent: Feb. 4, 2025

(54) CLIMBING TRAINING DEVICE

(71) Applicants: Tao Kulczycki, Villars sur Ollon (CH); Dan Arnklit, Brooklyn, NY (US)

(72) Inventors: Tao Kulczycki, Villars sur Ollon (CH); Dan Arnklit, Brooklyn, NY (US)

( * ) Notice: Subject to any disclaimer, the term of this patent is extended or adjusted under 35 U.S.C. 154(b) by 0 days.

(21) Appl. No.: 18/015,695

(22) PCT Filed: Dec. 2, 2021

(86) PCT No.: PCT/US2021/061556
§ 371 (c)(1),
(2) Date: Jan. 11, 2023

(87) PCT Pub. No.: WO2023/101672
PCT Pub. Date: Jun. 8, 2023

(65) Prior Publication Data
US 2024/0261654 A1 Aug. 8, 2024

(51) Int. Cl.
*A63B 69/00* (2006.01)
*A63B 21/00* (2006.01)
*A63B 23/035* (2006.01)
*A63B 23/16* (2006.01)

(52) U.S. Cl.
CPC ..... *A63B 69/0048* (2013.01); *A63B 21/4035* (2015.10); *A63B 23/03508* (2013.01); *A63B 23/16* (2013.01)

(58) Field of Classification Search
CPC ..... A63B 69/0048; A63B 21/4035; A63B 23/03508; A63B 23/16
See application file for complete search history.

(56) References Cited

U.S. PATENT DOCUMENTS 5,013,030 A * 5/1991 Frins ..... A63B 23/16 482/92
6,228,001 B1 * 5/2001 Johnson ..... A63B 21/028 482/44
6,702,723 B2 * 3/2004 Landfair ..... A63B 21/072 482/106
6,991,590 B2 * 1/2006 Vigiano ..... A63B 21/072 482/106
7,081,032 B1 * 7/2006 Holgate ..... A63H 33/18 446/46
D566,208 S * 4/2008 Alessandri ..... D21/681
D566,209 S * 4/2008 Alessandri ..... D21/681
8,585,563 B2 * 11/2013 Wilson ..... A63B 21/4035 482/141
9,844,694 B2 * 12/2017 Birt ..... A63B 23/1209
D851,711 S * 6/2019 Brezovar ..... D21/680
10,773,117 B1 * 9/2020 Goldberg ..... A63B 21/0724
(Continued)

*Primary Examiner* — Andrew S Lo
(74) *Attorney, Agent, or Firm* — Alozie Etufugh, ESQ.

(57) ABSTRACT

A climb training device, as either a solid piece or as having detachable cylindrical sections with uniform radius and tapering width, having first and second base sides, each base side having a periphery where the device, as a solid piece, or where each of the device's detachable sections has a widest width section and a narrowest width section. A hole is located at the device's center. The hole may include openings on the first and second base sides of the device and a bore connecting the openings. The first and second base sides of the device include contiguous grooves and one or more finger pockets all utilized for finger and hand strength training.

20 Claims, 21 Drawing Sheets

(56) References Cited

U.S. PATENT DOCUMENTS

| | | | | |
|---|---|---|---|---|
| 11,103,745 | B2 * | 8/2021 | Lin | G09B 15/06 |
| 2001/0049324 | A1 * | 12/2001 | Wallace | A63B 21/0783 482/106 |
| 2006/0079380 | A1 * | 4/2006 | Wells | A63B 21/4019 482/49 |

* cited by examiner

CLIMBING TRAINING DEVICE

FIELD OF THE INVENTION

The present invention is directed to climb training equipment and specifically, training devices configured to enable athletes to train different parts of their body with one training device.

BACKGROUND OF THE INVENTION

Climbing, as a sport, has gone from a niche sport to a worldwide sensation, with climbing being one of the fastest growing sports nowadays. Evidence of this may be gleaned from the publicity and exposure the sport garnered as a result of the climbing documentary, "Free Solo", which, in 2019, won the Oscar for best documentary film. Further still, in 2021, climbing as a sport had its debut at the Olympics. In light of these developments, climbing, as a recognized and respected sport, seems to have come to stay.

For training, climbers engage in finger and hand strength training for which there are two different types of training equipment. The first is a hang board, also called a fingerboard (for finger training) while the second is called the pinch block (for hand strength training).

The hang board trains finger strength through pockets. Hang boards are limited in their portability and are predominantly used inside gyms or in a house as they need to be attached permanently to a structure. As the name suggests, one can only hang from them, and they tend to be both heavy and bulky. Some hang boards, being smaller in size, are portable but are very limited in the number of pockets they have because of their size and shape. In addition, because of the rope position on their end extremities, they are extremely limited in use as they cannot have different pocket inclines (angles) and can only have one width pinch.

Then there is a pinch block, which is a small equipment whose purpose is grip or pinch training, a specific training for overall hand strength training. Because of their small size, these devices are extremely limited in the number of pockets that could be used for training.

In light of these limitations, current climb training equipment do not offer a device that provides all aspects of climb training, i.e. a device which enables both finger and pinch training while also being portable. As such, a climber has to always choose from something bulky that needs to be permanently attached to a structure or something smaller that is portable but limited in its use or pinch blocks which only have one purpose.

As such, there exists a need for equipment or a device that can provide all three aspects of climb training (portability, finger training and pinch training), in the same device. There is also a need for a training device that enables even more training capabilities by way of providing multiple tilting capacity made possible by varied pocket inclines and/or other characteristics.

SUMMARY OF THE INVENTION

An advantage of an aspect of an embodiment of the contemplated invention is its ability to enable training for the upper body, and hand and finger strength with the same device.

Another advantage of an aspect of an embodiment of the contemplated invention is its dual function arising from its structural configuration which, inter alia, allows for a climber to use two sides for finger pockets and a range of widths for grip or pinch training.

Another advantage of an aspect of an embodiment of the contemplated invention is the presentation of multiple training hold types in one training device.

Another advantage of an aspect of an embodiment of the contemplated invention is its versatility of use with weights, elastic bands, as a hanging training device, or as a portable on-the-go training tool that can be used within or outside a gym or indoor facility.

Another advantage of an aspect of an embodiment of the contemplated invention is its ability to be used by climbers at all levels of climbing proficiency.

Aspects of embodiments of the present invention provide an extremely useful tool which, thanks to the distinctive and utilitarian aspects of various embodiments, enables users or climbers to train upper body, hand and finger strength in two distinctive ways, i.e., finger pocket training and pinch training. The uniqueness of aspects of various embodiments of the contemplated invention also enables its use with weights, elastic bands, hanging exercises/training, as a portable on the go training tool or in the gym. Specifically, certain elements of aspects of various embodiments of the contemplated invention provide additional advantages over the existing art. These are discussed below:

Pockets: With the different structural configurations and its double side use, in one aspect of an embodiment of the present invention, the pockets may be positioned or located around the inner circumference thereby allowing the climb training device to fit more pockets in a smaller amount of space than prior art configurations. The tilting capacity of certain aspects of various embodiments of the present invention enables incline (angle) alteration of pockets. Further still, the different structural configurations of certain aspects of various embodiments of the present invention enables the climb training device to have more pocket depths and alterations than any other hang boards in the market, whether a portable hang board or an indoor installed hang board.

Pinch: With particular aspects of various embodiments of the contemplated invention enabling a "double sided truncated cylinder", the width size may vary throughout the equipment, thereby providing a multitude of pinch sizes for which to train. This is even doubled with a particular aspect of an embodiment of the contemplated invention which contemplates two separated "right circular truncated cylinders" units or sections, which allow for even more pinch width choice.

Portability/outside use: With certain structural configurations called for by aspects of embodiments of the present invention, the climb training device is smaller than any portable hang board, thereby creating a light, packable and portable tool that can fit comfortably in a bag. It also presents the ability to separate into two units with two ropes, allowing it to be hung from anywhere.

In gym/inside use: With the many pocket depths, variations of angles and pinches as presented by aspects of embodiments of the present invention, the climb training device is more useful than a static bulky indoor hang board. Also, it has the advantage of not requiring screws or a structure to be attached to for use or operation.

An aspect of an embodiment of the present invention contemplates a climb training device, which may include a solid cylindrical piece with a uniform radius and a tapering width, having first and second base sides, with each base side having a periphery, where the solid cylindrical piece comprises of a widest width section and a narrowest width section. In an aspect of an embodiment of the present invention, the solid cylindrical piece may include sections having widths that are: (a) narrower than the widest width section but (b) wider than the narrowest width section. In an aspect of an embodiment of the present invention, the solid cylindrical piece may include a hole at the cylindrical piece's center, where the hole includes openings on the first and second base sides and a bore connecting the openings, where the first base side includes a contiguous groove, with the contiguous groove positioned between the hole opening on the first base side and the first base side's periphery, where the first base side includes at least one finger pocket located between the contiguous groove and the first base side's periphery, where the first base side includes an island surrounded by the contiguous groove, where the second base side includes a contiguous groove, the contiguous groove positioned between the hole opening on the second base side and the second base's periphery, and where the second base side includes an island surrounded by the contiguous groove.

In an aspect of an embodiment of the present invention, the island of the second base side of the climb training device may include at least one finger pocket.

In an aspect of an embodiment of the present invention, at least one of either the contiguous groove of the first base side or the contiguous groove of the second base side of climb training device, is a hexagonally shaped groove.

In an aspect of an embodiment of the present invention, each side of the hexagonally shaped groove may be inclined at a different angle relative to each other.

In an aspect of an embodiment of the present invention, each side of the hexagonally shaped groove may have a different depth.

In an aspect of an embodiment of the present invention, at least one finger pocket of the climb training device may include at least one recessed pocket.

In an aspect of an embodiment of the present invention, the at least one finger pocket of the climb training device may include at least one hole.

In an aspect of an embodiment of the present invention, at least one of: the first base side or the second base side may be inclined at an angle to a plane passing through the widest width section's midpoint and the narrowest width section's midpoint.

Another aspect of an embodiment of the present invention contemplates a climb training device, comprising: a solid cylindrical piece with uniform radius and tapering width, having first and second base sides, with each base side having a periphery, and where the solid cylindrical piece comprises of a widest width section and a narrowest width section. In an aspect of an embodiment of the present invention, the solid cylindrical piece may include sections having widths that are: (a) narrower than the widest width section but (b) wider than the narrowest width section. In an aspect of an embodiment of the present invention, the solid cylindrical piece may also include a hole at the cylindrical piece's center, where the hole includes openings on the first and second base sides and a bore connecting the openings, where any one or both of: the first base side and second base side includes at least one finger pocket.

In another aspect of an embodiment of the present invention, the at least one finger pocket of the climb training device may be positioned between the hole opening on the first base side and the periphery of the first base side.

In another aspect of an embodiment of the present invention, the at least one finger pocket of the climb training device may be positioned between the hole opening on the second base side and the periphery of the second base side.

In another aspect of an embodiment of the present invention, the finger pocket(s) of the climb training device may each have different sizes in relation to each other.

In another aspect of an embodiment of the present invention, the finger pocket(s) of the climb training device may each have different depths in relation to each other.

In another aspect of an embodiment of the present invention, the climb training device may further include a first pinch grip groove and second pinch grip groove, where the second pinch grip groove may be positioned between the periphery and the hole, and where the first pinch grip groove may be positioned between the periphery and the second pinch grip groove.

In another aspect of an embodiment of the present invention, the first pinch grip groove and the second pinch grip groove of the climb training device may both be positioned as concentric grooves around the hole.

In another aspect of an embodiment of the present invention, the first pinch grip groove of the climb training device may include a smooth surface.

In another aspect of an embodiment of the present invention, the second pinch grip groove of the climb training device may include a surface of different textures.

In another aspect of an embodiment of the present invention, at least one of the first base side or the second base side of the solid cylindrical piece may be inclined at an angle to a plane passing through: (a) the midpoint of the widest width section and (b) the narrowest width section of the solid cylindrical piece.

A further aspect of an embodiment of the present invention contemplates a climb training device, comprising: a first detachable cylindrical section, comprising of first and second base sides, and a second detachable cylindrical section, comprising of first and second base sides, where each of the first detachable cylindrical section and a second detachable cylindrical section includes a uniform radius and a tapering width, where each of the first and second detachable cylindrical sections comprises of a widest width section and a narrowest width section. In an aspect of an embodiment of the present invention, each of the first and second detachable cylindrical sections comprises of width sections that are: (a) narrower than the widest width section but (b) wider than the narrowest width section. In a further aspect of an embodiment of the present invention, the second detachable cylindrical section includes at least one bore for connection with the first detachable cylindrical section, where the first detachable cylindrical section includes at least one dowel adapted to connect with the at least one bore of the second detachable cylindrical section, and where each of the first detachable cylindrical section and a second detachable cylindrical section includes a hole at each of the section's center, where the hole includes openings on the first and second base sides of each respective section and a bore connecting the openings.

In a further aspect of an embodiment of the present invention, the first detachable cylindrical section and a second detachable cylindrical section of the climb training device may each comprise of a periphery.

In a further aspect of an embodiment of the present invention, any one or both of the first detachable cylindrical section or the second detachable cylindrical section may include at least one finger pocket positioned between the hole of the respective section and the respective periphery of the section.

In a further aspect of an embodiment of the present invention, both the first detachable cylindrical section and the second detachable cylindrical section may include a variety of different recessed finger pockets on each respective first side of each section.

In a further aspect of an embodiment of the present invention, both the first detachable cylindrical section and the second detachable cylindrical section may include a contiguous groove around the respective hole on each respective first side of each section.

In a further aspect of an embodiment of the present invention, the second base side of both the first detachable cylindrical section and the second detachable cylindrical section may be flat.

In a further aspect of an embodiment of the present invention, at least one of: the first base side of the first detachable cylindrical section or the first base side of the second detachable cylindrical section may be inclined at an angle to a plane parallel to one of: the second base side of the first detachable cylindrical section or the second base of the second detachable cylindrical section.

In a further aspect of an embodiment of the present invention, at least one of: the first base side of the first detachable cylindrical section or the first base side of the second detachable cylindrical section may be inclined at an angle to a plane passing through the midpoint of: (a) the combined width of the widest width sections of the first detachable cylindrical section and the second detachable cylindrical section and (b) the combined width of the narrowest width sections of the first detachable cylindrical section and the second detachable cylindrical section.

PARTS/ELEMENTS

Figure 1A:
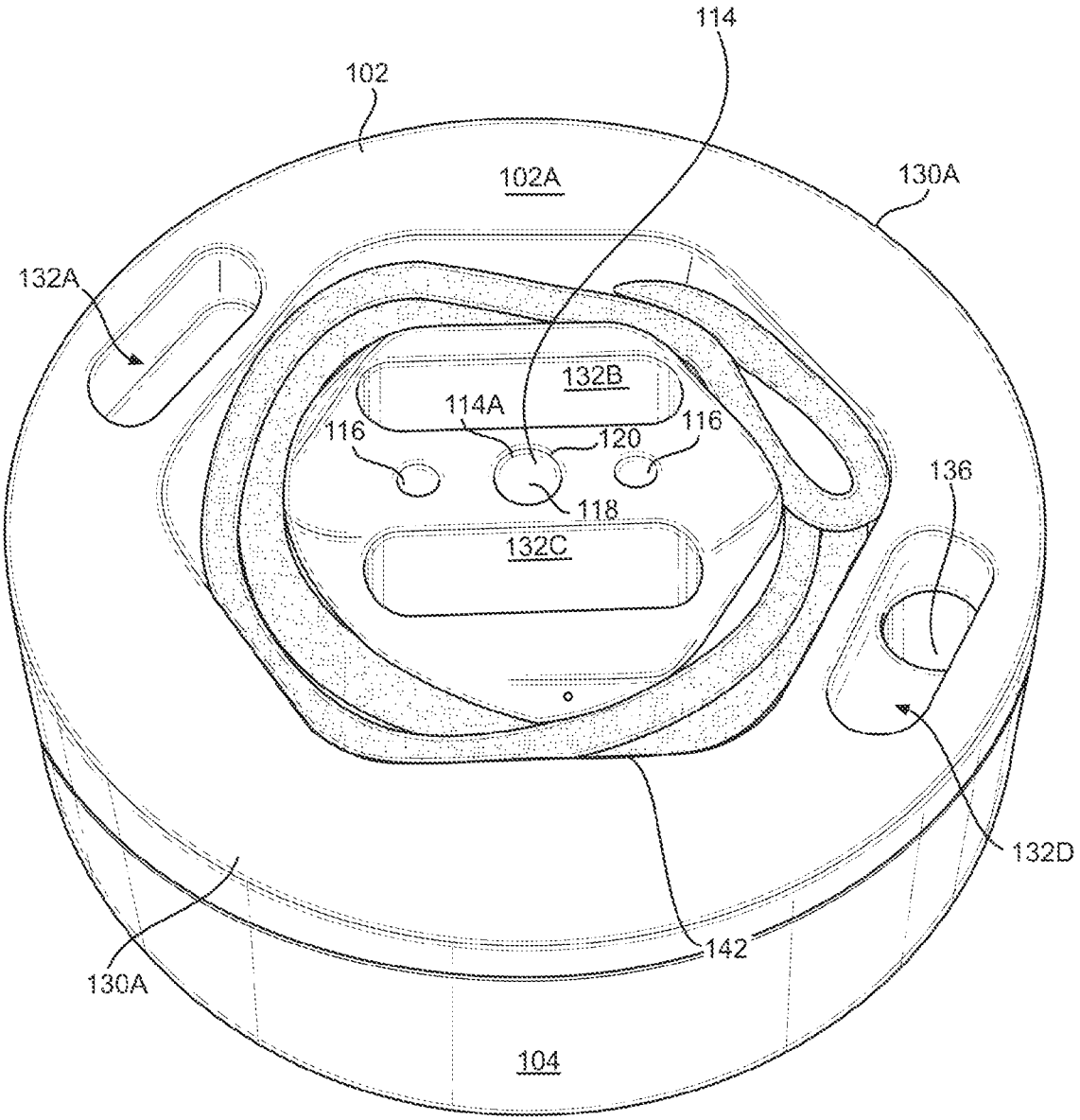
FIG. 1A illustrates a perspective view of a two-piece climb training device according to an aspect of an embodiment of the present invention.
Figure 1B:
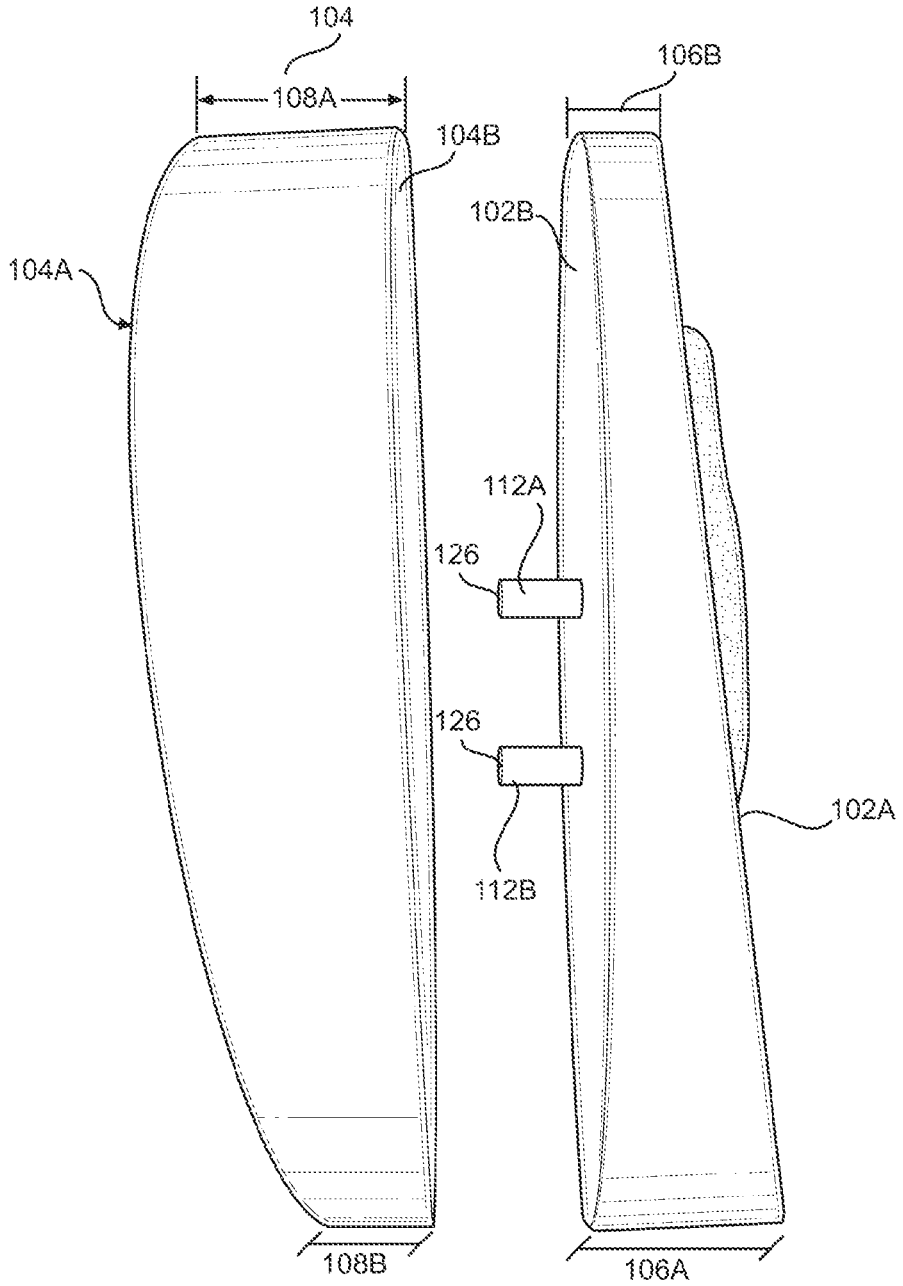
FIG. 1B illustrates a side view of a two-piece climb training device according to an aspect of an embodiment of the present invention.

100 Climb training device
102 First detachable cylindrical section
102A First base side of First detachable cylindrical section
102B Second base side of First detachable cylindrical section
104 Second detachable cylindrical section
104A First base side of Second detachable cylindrical section
104B Second base side of Second detachable cylindrical section
106A Widest width section of First detachable cylindrical section
106B Narrowest width section of First detachable cylindrical section
108A Widest width section of Second detachable cylindrical section
108B Narrowest width section of Second detachable cylindrical section
110A-110B Connection bore(s) (Second detachable cylindrical section)
112A-112B Connection dowels (First detachable cylindrical section)
114 Hole (First detachable cylindrical section)
114A Hole Opening on first base side (First detachable cylindrical section)
114B Hole Opening on second base side (First detachable cylindrical section)
116A-116B First base side of connection bores 110A-110B
118 Bore of First detachable cylindrical section
120 Center of First detachable cylindrical section
122 Center of Second detachable cylindrical section
124 Hole of Second detachable cylindrical section

124A Hole Opening on First base side of Second detachable cylindrical section
124B Hole Opening on Second base side of Second detachable cylindrical section
126A-126B Ends of connection dowels (112A-112B)
128 Bore of Second detachable cylindrical section
130A Periphery of First detachable cylindrical section
130B Periphery of Second detachable cylindrical section
132A-132D Finger pocket(s) of First detachable cylindrical section
134A-134D Finger pocket(s) of Second detachable cylindrical section
136A-136B Recessed Finger Pockets of First base side of First detachable cylindrical section
138A-138B Recessed Finger Pockets of First base side of Second detachable cylindrical section
140 Contiguous Groove of First detachable cylindrical section
142 Contiguous Groove of Second detachable cylindrical section
200 Climb training device
202A Widest width section
202B Narrowest width section
204 First base side
206 Second base side
208 First base side periphery
210 Second base side periphery
212 Hole
214 Cylindrical piece center
212A First base side Hole Opening
212B Second base side Hole Opening
216 Bore
218 First base side contiguous groove
220A & 220B Finger pockets
222 First base side Island
224 Second base side contiguous groove
226 Second base side island
228A & 228B Second base side island finger pocket(s)
218A-218F & 224A-224F Hexagonally shaped groove side(s)
230 Recessed finger pocket (within finger pocket)
300 Climb training device
302A Widest width section
302B Narrowest width section
304 First base side
306 Second base side
308 Periphery of First base side
310 Periphery of Second base side
312 Hole
312A Hole Opening on First base side
312B Hole Opening on Second base side
314 Cylindrical piece center
316 Bore
318 Finger Pocket
400 Climb training device
402A Widest width section
402B Narrowest width section
404 First base side
406 Second base side
408 Periphery of First base side
410 Periphery of Second base side
412 Hole
412A Hole Opening on First base side
412B Hole Opening on Second base side
414 Cylindrical piece center
416 Bore
418A-418E Finger Pockets
420 First pinch grip groove
422 Second pinch grip groove
500 Illustrative/exemplary climb training device
502A-502C Illustrative/exemplary pockets
504A Illustrative/exemplary widest width section
504B Illustrative/exemplary narrowest width section
506 Illustrative/exemplary recessed finger pocket
508 Illustrative/exemplary Bore
R Rope
C Climber
E Elastic band
TB Threaded bolt(s)
W Weight(s)
FS Fixed structure

DETAILED DESCRIPTION

Figure 1C:
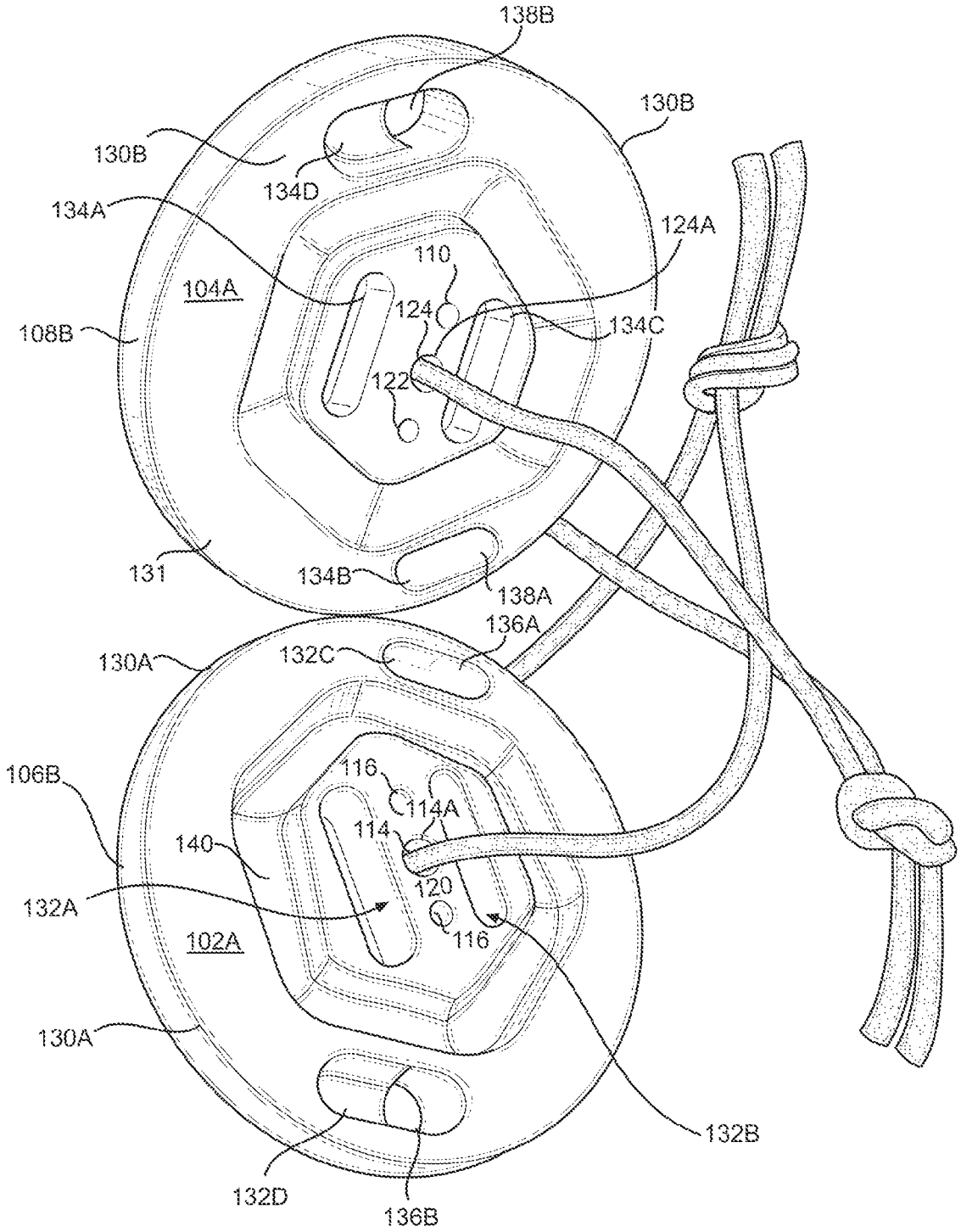
FIG. 1C illustrates a perspective side view of two first base side sections of a two-piece climb training device according to an aspect of an embodiment of the present invention.
Figure 1D:
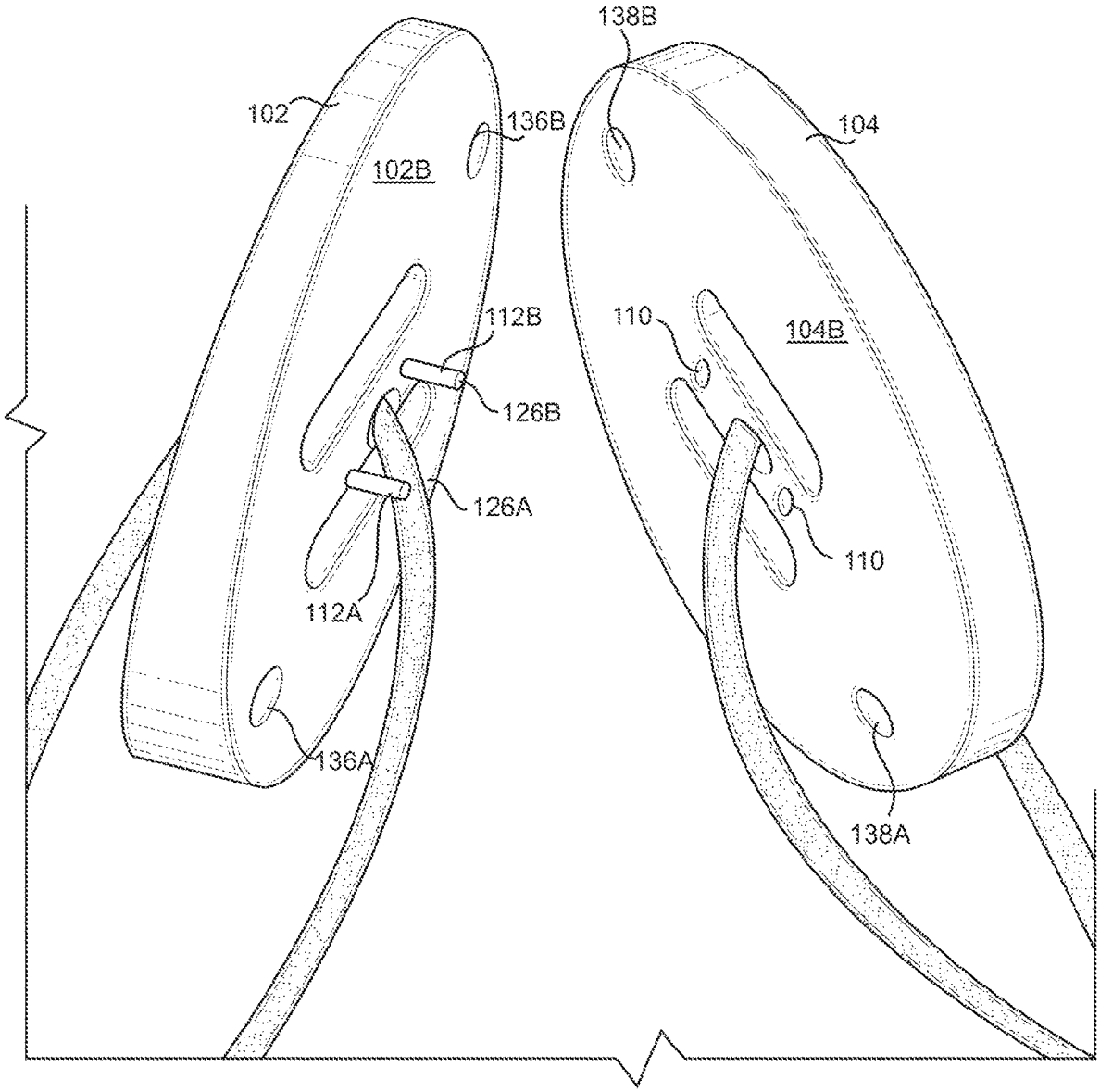
FIG. 1D illustrates a perspective side view of two sections of a two-piece climb training device according to an aspect of an embodiment of the present invention.

Referring now to FIGS. 1A-1F, different views of two-piece climb training device 100 are shown or illustrated according to aspects of embodiments of the present invention. Climb training device 100 may include first detachable cylindrical section 102 which in turn may include first base side 102A and second base side 102B (FIG. 1C). Climb training device 100 may also include second detachable cylindrical section 104 which in turn may include first base side 104A and second base side 104B. In an aspect of an embodiment of the present invention, each of first detachable cylindrical section 102 and second detachable cylindrical section 104 may have a uniform radius and tapering widths, with widest width section 106A and narrowest width section 106B for first detachable cylindrical section 102 and with widest width section 108A and narrowest width section 108B for second detachable cylindrical section 104. In an aspect of an embodiment of the present invention, first detachable cylindrical section 102 of climb training device 100 may include width sections that are: (a) narrower than widest width section 106A but (b) wider than narrowest width section 106B. In an aspect of an embodiment of the present invention, first detachable cylindrical section 104 of climb training device 100 may include width sections that are: (a) narrower than widest width section 108A but (b) wider than narrowest width section 108B. A possible combination of these widths makes the tapering structural quality/characteristic of climb training device 100 possible.

In an aspect of an embodiment of the present invention, second detachable cylindrical section 104 may include one or more connection bore(s) 110A-110B for connection with first detachable cylindrical section 102, and first detachable cylindrical section 102 may include one or more dowels 112A-112B adapted to connect with one or more connection bore(s) 110A-110B of second detachable cylindrical section 104.

In an aspect of an embodiment of the present invention, first detachable cylindrical section 102 and second detachable cylindrical section 104 may each include holes 114, 124 respectively at each of said section's center (120 for first detachable cylindrical section 102 and 122 for second detachable cylindrical section 104). Hole 114 may further comprise of hole opening 114A on first base side 102A of first detachable cylindrical section 102 and hole opening 114B on second base side 102B of first detachable cylindrical section 102. Hole 124 may further comprise of hole opening 124A on first base side 104A of second detachable cylindrical section 104 and hole opening 124B on second base side 104B of second detachable cylindrical section 104. Hole openings 114A and 114B, in an aspect of an embodiment of the present invention, may be connected by bore 118, while hole openings 124A and 124B, in an aspect of an embodiment of the present invention, may be connected by bore 128.

In an aspect of an embodiment of the present invention, first detachable cylindrical section 102 may comprise of periphery 130A while second detachable cylindrical section 104 may comprise of periphery 130B, where each periphery, in an aspect of an embodiment of the present invention, may constitute or define the outer edge of each detachable cylindrical section.

In an aspect of an embodiment of the present invention, any one or both of: first detachable cylindrical section 102 and second detachable cylindrical section 104 may comprise of one or more finger pockets 132A-132D (for first detachable cylindrical section 102) and one or more finger pockets 134A-134D (for second detachable cylindrical section 104). In an aspect of an embodiment of the present invention, one or more finger pockets 132A-132D of first detachable cylindrical section 102 may be positioned between hole 114 and periphery 130A of first detachable cylindrical section 102 while one or more finger pockets 134A-134D of second detachable cylindrical section 104 may be positioned between hole 124 and periphery 130B of second detachable cylindrical section 104. It should be noted that depiction and disclosure of finger pockets 132A-132D and finger pockets 134A-134D is illustrative only and not limiting as fewer or more finger pockets are also contemplated by aspects of embodiments of the present invention.

In an aspect of an embodiment of the present invention, any one or both of: first detachable cylindrical section 102 and second detachable cylindrical section 104 may comprise of a variety of different recessed finger pockets. For instance, first detachable cylindrical section 102 may include recessed finger pocket 136 (see, FIGS. 1A and 1C), which, in one aspect of an embodiment of the present invention, may comprise of holes located within finger pockets 132C and 132D, respectively and extending from first base side 102A of first detachable cylindrical section 102 to second base side 102B of first detachable cylindrical section 102.

Likewise, in an aspect of an embodiment of the present invention, second detachable cylindrical section 104 may include recessed finger pockets 138A and 138B (FIG. 1C), which, in one aspect of an embodiment of the present invention, may comprise of holes located within finger pocket 134C and 134D, respectively and extending from first base side 104A of second detachable cylindrical section 104 to second base side 104B of first detachable cylindrical section 104.

It should be noted that the disclosure or illustrations of recessed finger pockets 136A-136B and 138A-138B are illustrative only and not limiting as more or fewer recessed finger pockets are also contemplated by aspects of embodiments of the present invention.

In an aspect of an embodiment of the present invention, any one or both of: first detachable cylindrical section 102 and second detachable cylindrical section 104 may comprise of contiguous groove 142 (for first detachable cylindrical section 102) and/or contiguous groove 144 (for second detachable cylindrical section 104) around said respective holes 114, 124 on each respective first base side (102A, 102B) of each respective section.

In an aspect of an embodiment of the present invention, the second base side (102B, 104B) of any one or both of: first detachable cylindrical section 102 and second detachable cylindrical section 104 may be flat.

Figure 1E:
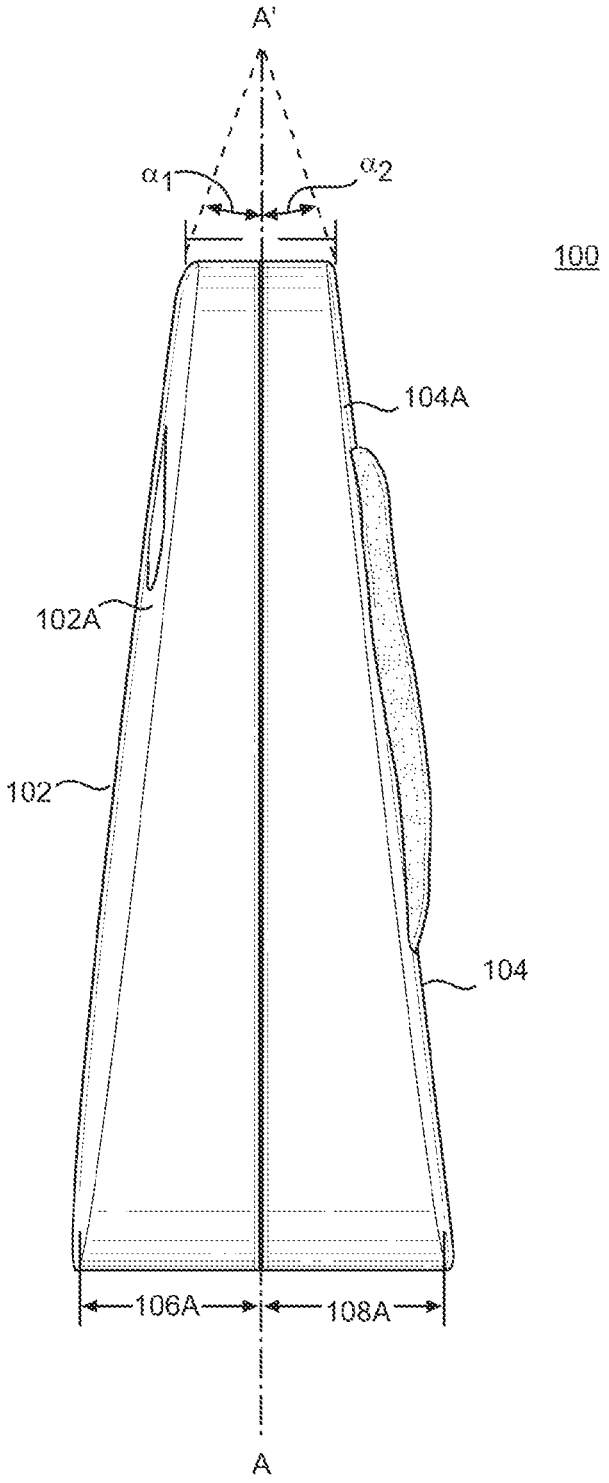
FIG. 1E illustrates a side view of a two-piece climb training device with both sections combined to form one unit according to an aspect of an embodiment of the present invention.

Referring specifically to FIG. 1E, in an aspect of an embodiment of the present invention, first base side 102A may be inclined at an angle, $\alpha_1$, to plane A-A' thereby effecting the tapering of first detachable cylindrical section 102 of climb training device 100 from widest width section 106A down to narrowest width section 106B. In an aspect of an embodiment of the present invention, first base side 104A of second detachable cylindrical section 104 may be inclined at an angle, $\alpha_2$, to plane A-A' thereby effecting the tapering of second detachable cylindrical section 104 of climb training device 100 from widest width section 108A down to narrowest width section 108B. In aspects of embodiments of the present invention, the angles $\alpha_1$ and $\alpha_2$ may be equal or different.

In an aspect of an embodiment of the present invention, first base side 102A of first detachable cylindrical section 102 or first base side 104A of second detachable cylindrical section 104 may be inclined at an angle to a plane parallel to one of: second base side 102B of first detachable cylindrical section 102 or second base side 104B of second detachable cylindrical section 104.

In an aspect of an embodiment of the present invention, at least one of: first base side 102A of first detachable cylindrical section 102 or first base side 104A of second detachable cylindrical section 104 may be inclined at an angle to a plane A-A' passing through the midpoint of: (a) the combined width of widest width sections 106A and 108A (respectively of first detachable cylindrical section 102 and second detachable cylindrical section 104) and (b) the combined width of narrowest width sections 106B and 108B (respectively of first detachable cylindrical section 102 and second detachable cylindrical section 104).

In another aspect of an embodiment of the present invention either of first base side 102A or second base side 102B of first detachable cylindrical section 102 may be inclined at an angle in relation to plane A-A'. In yet another aspect of an embodiment of the present invention, only one of first base side 102A or second base side 102B of first detachable cylindrical section 102 may be inclined at an angle in relation to plane A-A'.

In another aspect of an embodiment of the present invention either of first base side 104A or second base side 104B of second detachable cylindrical section 104 may be inclined at an angle in relation to plane A-A'. In yet another aspect of an embodiment of the present invention, only one of first base side 104A or second base side 104B of second detachable cylindrical section 104 may be inclined at an angle in relation to plane A-A'. Plane A-A', it should be noted may, in aspects of embodiments of the present invention, be parallel to any given horizontal plane.

Figure 1F:
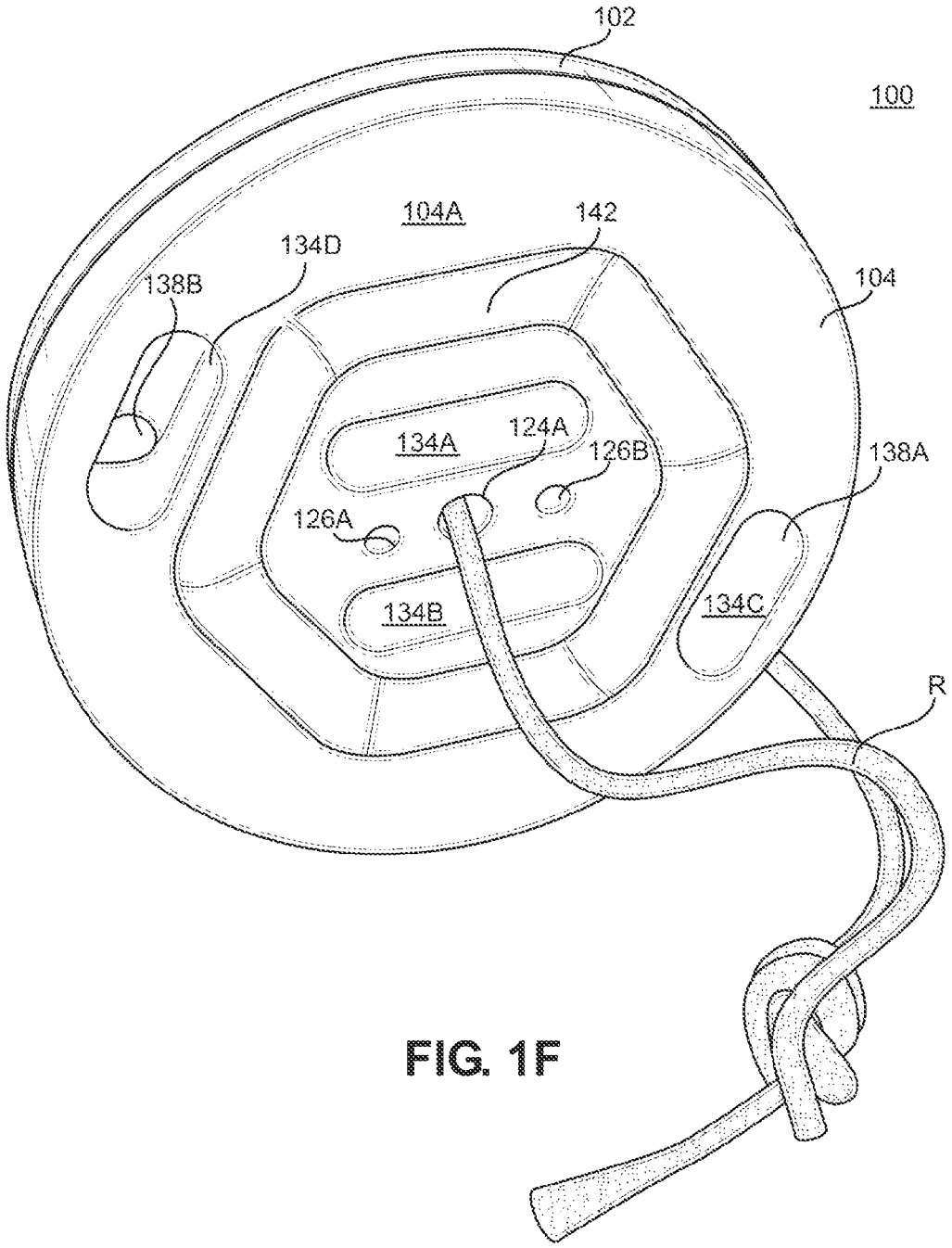
FIG. 1F illustrates a side perspective view of one section of a two piece climb training device according to an aspect of an embodiment of the present invention.

Referring specifically to FIG. 1F, first and second detachable cylindrical sections 102 and 104, may be combined for use as one unit by inserting connection dowels 112A and 112B of first detachable cylindrical section 102 into connection bores 110A and 110B of second detachable cylindrical section 104, with the ends 126A and 126B of connection dowels 112A and 112B extending through to the first base side 104A of second detachable cylindrical section 104 as shown.

Figure 1G:
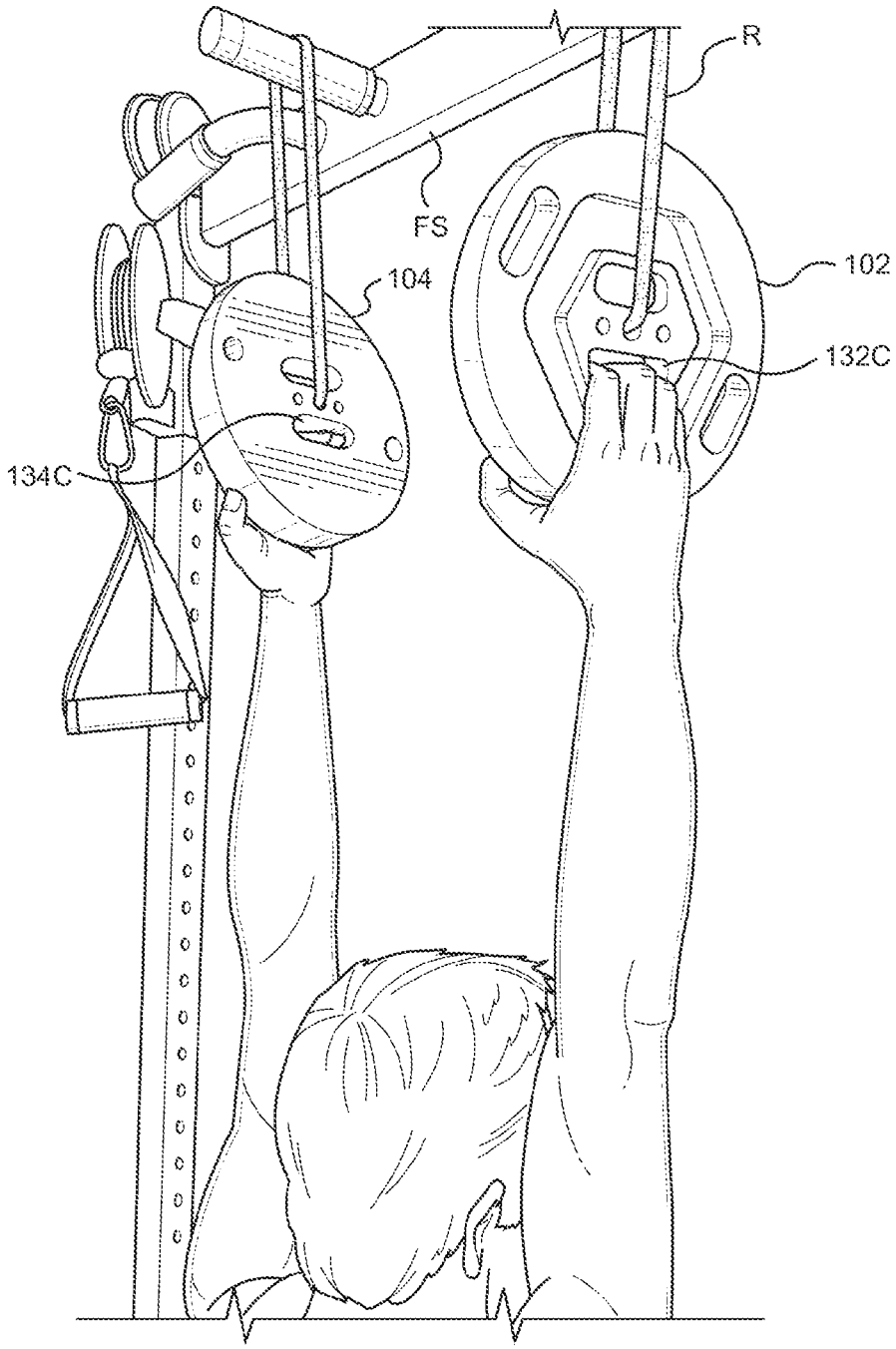
FIG. 1G illustrates a side perspective view of sections of a two piece climb training device being used in conjunction with a fixed structure according to an aspect of an embodiment of the present invention.
Figure 1H:
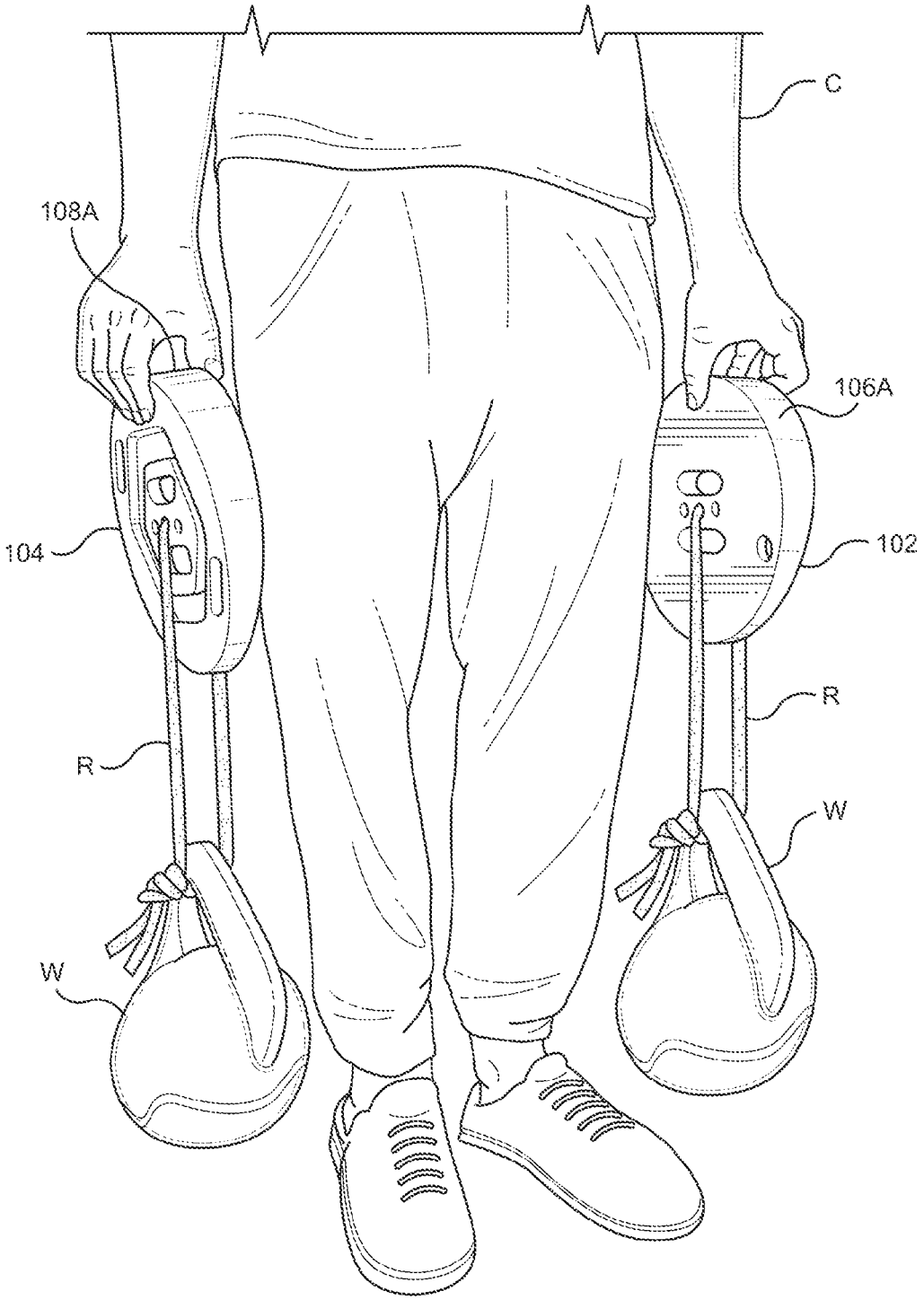
FIGS. 1H-1I illustrate side perspective views of sections of a two piece climb training device being used separately for pinch and pocket training according to an aspect of an embodiment of the present invention.
Figure 1I:
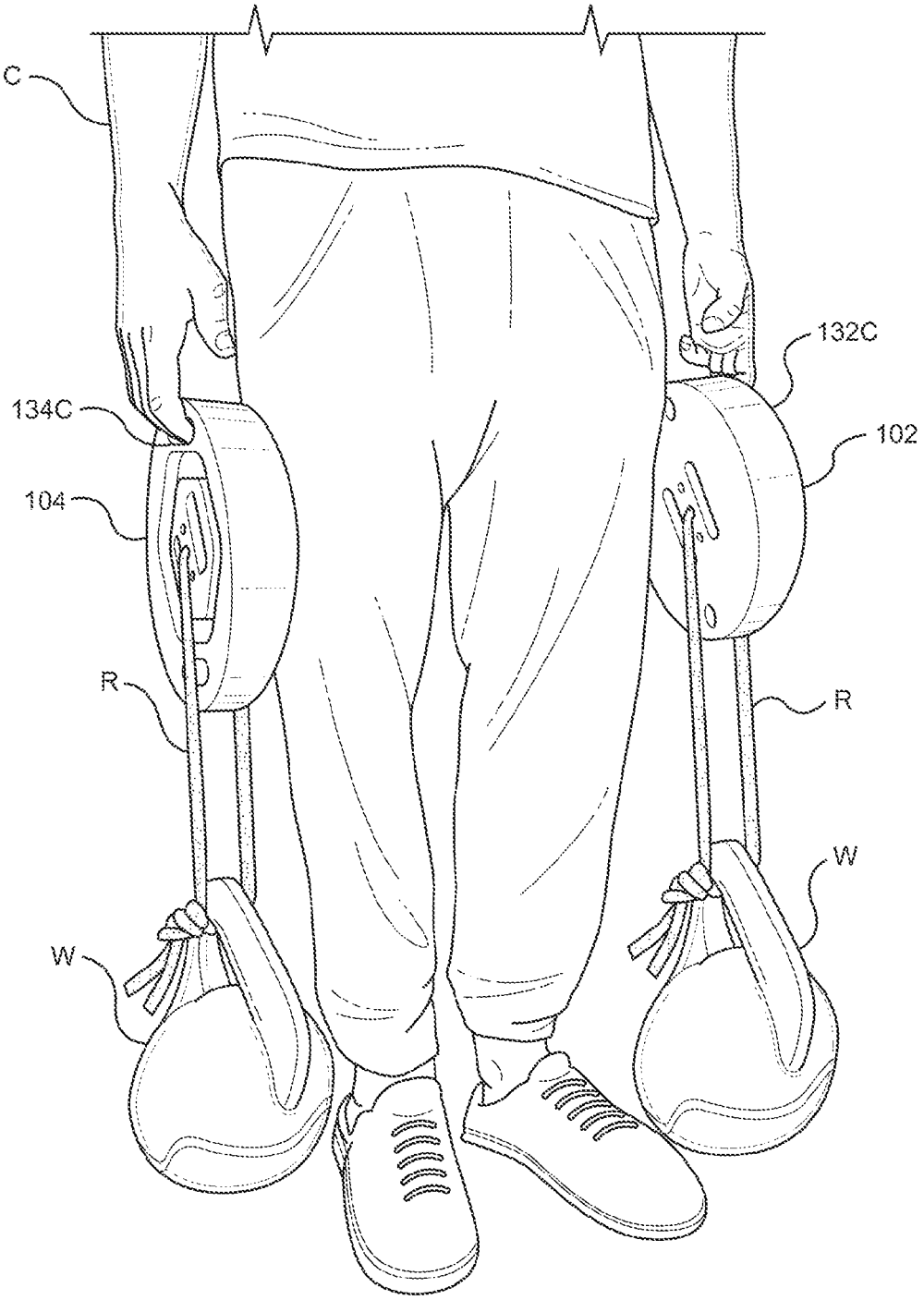

Referring now to FIGS. 1G through 1I, perspective views of sections of two piece climb training device 100 are shown as climb training device 100 is used in conjunction with a fixed structure and sections 102 and 104 of two piece climb training device 100 are also shown as being used separately for pinch and pocket training according to aspects of embodiments of the present invention.

Referring specifically to FIG. 1G, a climber, C, may conduct upper body strength training and finger training by hanging each of first and second detachable cylindrical sections 102 and 104 from respective attachment means such as rope, R from a fixed structure, FS as shown. Climber C may conduct such training by inserting his/her fingers into finger pockets of first and second detachable cylindrical sections 102 and 104 such as 132C and 134C while first and second detachable cylindrical sections 102 and 104 are hung from fixed structure, FS.

Referring specifically to FIGS. 1H and 1I, a climber, C, may conduct pinch and pocket training by hanging weights, W from each of first and second detachable cylindrical sections 102 and 104 using rope, R. It should be noted that the use of rope, R does not limit the additional ways in which the weights may be hung as they may also be hung using elastic bands/cords. Rope R may also be used in conjunction with climb training device 100 by using threaded bolts as well to thread through bores of first and second detachable cylindrical sections 102 and 104 and connecting each end of threaded bolts using either rope or elastic bands/cords.

Referring now to FIGS. 2A through 2E different views of a climb training device 200 are shown according to aspects of embodiments of the present invention. Climb training device 200 may be a solid cylindrical piece having a uniform radius and a tapering width section from a widest width section 202A tapering down to a narrowest width section 202B. In an aspect of an embodiment of the present invention, climb training device 200 may comprise of widest width section 202A and narrowest width section 202B.

Climb training device 200 may also include a first base side 204 and a second base side 206 with first base side 204 having a periphery 208 and second base side 206 having a periphery 210. Climb training device 200 may also include a hole 212 located at climb training device 200's center 214, where hole 212 may include openings 212A and 212B respectively on first base side 204 and second base side 206. A bore 216 connects openings 212A and 212B. In an aspect of an embodiment of the present invention, bore 216 may serve as a receptacle for receiving rope, R, (see, for example, FIGS. 2D & 2E) which may be used in a variety of ways by the climber. Alternatively, elastic cords may be used in lieu of rope, R.

Figure 2A:
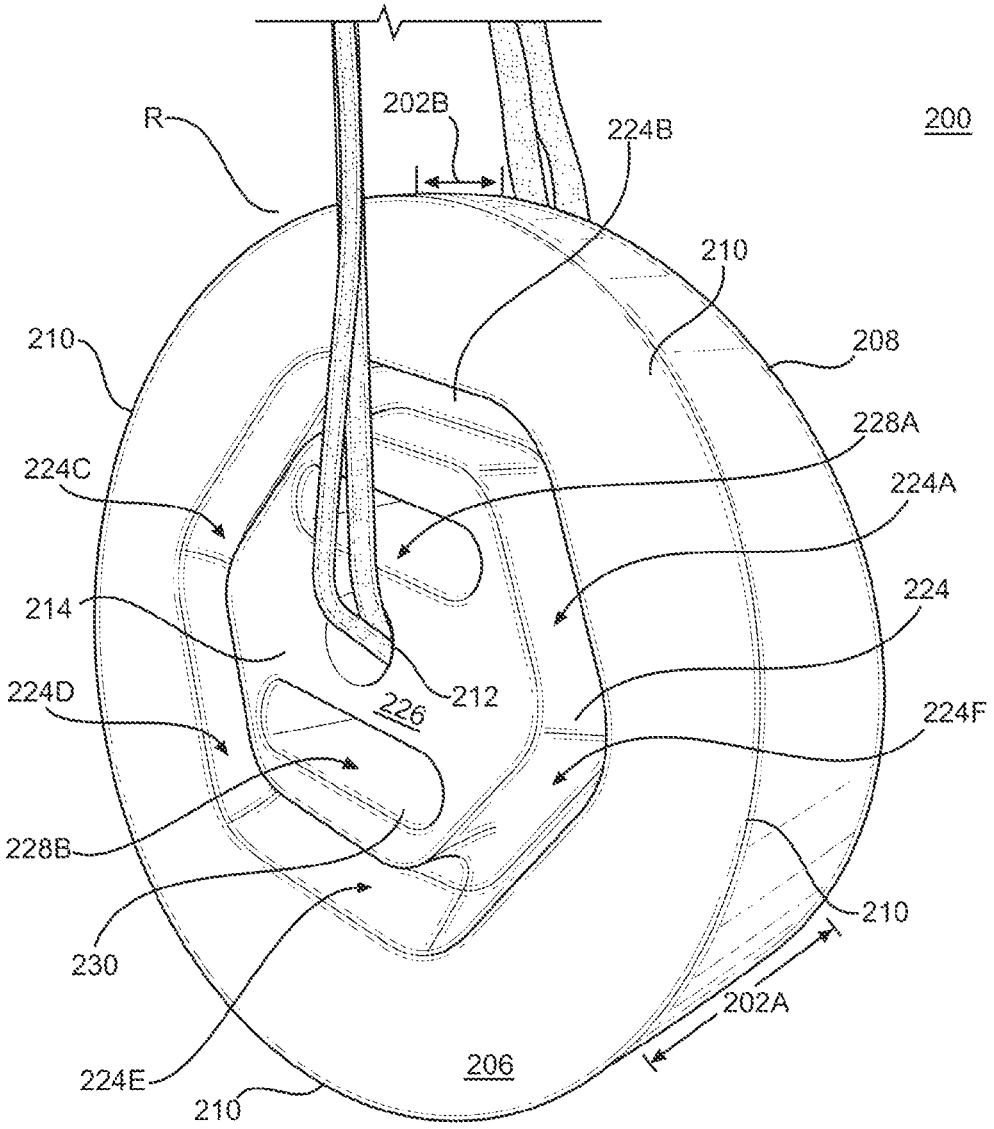
FIG. 2A illustrates a perspective view of a second base side of a climb training device according to an aspect of an embodiment of the present invention.
Figure 2B:
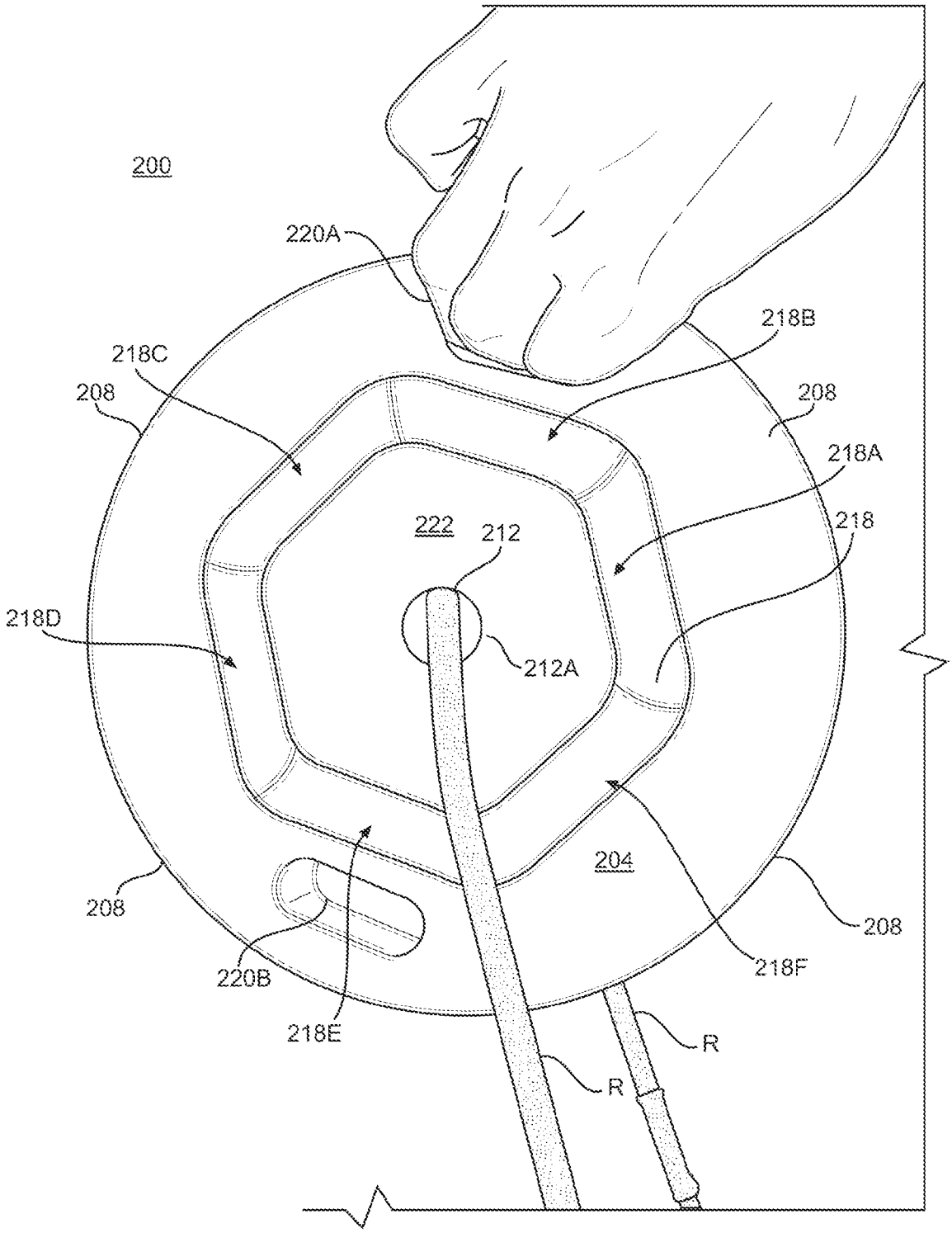
FIG. 2B illustrates a front view of a first base side of a climb training device according to an aspect of an embodiment of the present invention.
Figure 2C:
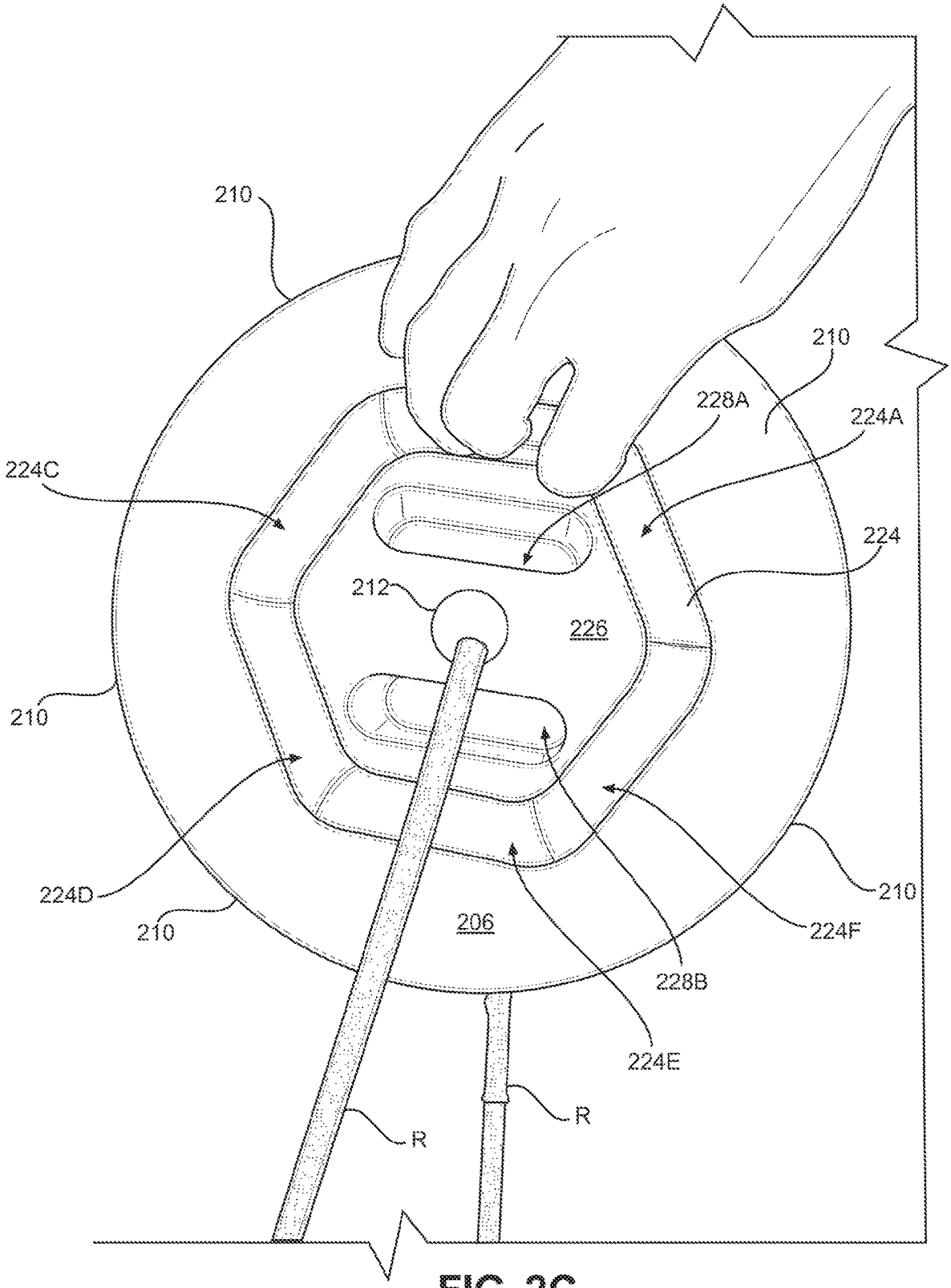
FIG. 2C illustrates a front view of a second base side of a climb training device according to an aspect of an embodiment of the present invention.
Figure 2D:
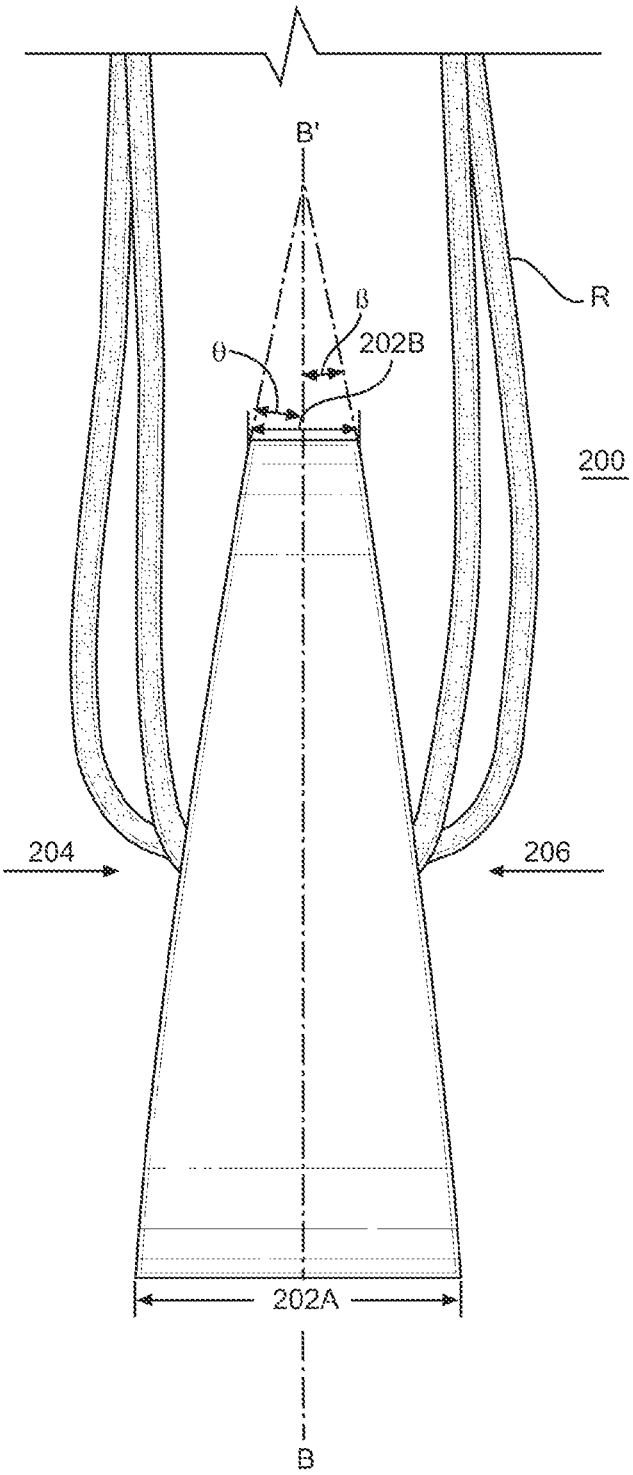
FIG. 2D illustrates a side view of a climb training device according to an aspect of an embodiment of the present invention.
Figure 2E:
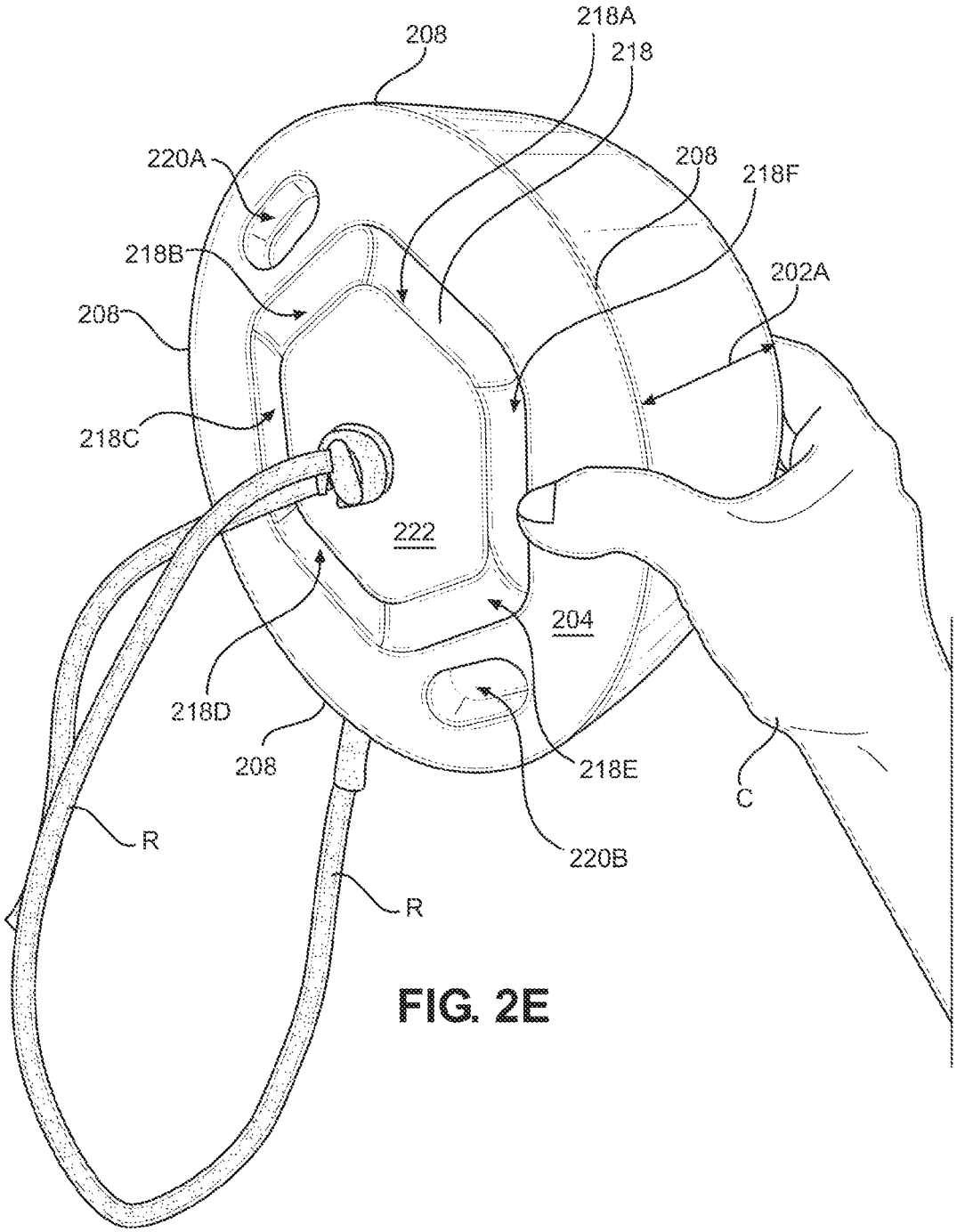
FIG. 2E illustrates a perspective view of a first base side of a climb training device according to an aspect of an embodiment of the present invention.

Referring specifically to FIG. 2D, in an aspect of an embodiment of the present invention, first base side 204 may be inclined at an angle, θ, to plane B-B' thereby effecting the tapering of climb training device 200 from wide width section 202A down to narrower width section 202B. In an aspect of an embodiment of the present invention, second base side 206 may also be inclined at the same angle, θ, to plane B-B'. In another aspect of an embodiment of the present invention, second base side 206 may be inclined at a different angle, ß, to plane B-B'. In another aspect of an embodiment of the present invention either of first base side 204 or second base side 206 may be inclined at an angle in relation to plane B-B'. In yet another aspect of an embodiment of the present invention, only one of first base side 204 or second base side 206 may be inclined at an angle in relation to plane B-B'. In another aspect of an embodiment of the present invention, at least one of the first base side 204 or the second base side 206, may be inclined at an angle to a plane passing through: (a) the midpoint of widest width section 202A and (b) the midpoint of narrowest width section 202B. Plane B-B', it should be noted may, in aspects of embodiments of the present invention, be parallel to any given horizontal plane.

Referring specifically to FIG. 2B, in an aspect of an embodiment of the present invention, first base side 204 may include a contiguous groove 218 which may be located or positioned between hole 212 and first base side 204's periphery 208. First base side 204 may also include one or more finger pocket(s) 220A and 220B located between contiguous groove 218 and first base side 204's periphery 208. First base side 204 may further include an island 222 surrounded by contiguous groove 218. It should be noted that depiction and disclosure of finger pockets 220A and 220B is illustrative only and not limiting as more or less number(s) of finger pockets and different positions of finger pockets 220A and 220B are also contemplated.

Referring specifically to FIG. 2C, in an aspect of an embodiment of the present invention, second base side 206 may include its own contiguous groove 224, where contiguous groove 224 may be located or positioned between hole 212 and second base side 206's periphery 210. In another aspect of an embodiment of the present invention. second base side 206 may include an island surrounded by contiguous groove 224.

In an aspect of an embodiment of the present invention, island 226 of second base side 206 may include one or more finger pockets 228A and 228B. It should be noted that depiction and disclosure of finger pockets 228A and 228B is illustrative only and not limiting as more or less number(s) of finger pockets are also contemplated.

In an aspect of an embodiment of the present invention, any one or both of contiguous groove 218 of first base side 204 and contiguous groove 224 of second base side 206 may be hexagonal in shape/configuration. In aspects of embodiments of the present invention, each of the sides 218A-218F and 224A-224F of said hexagonally shaped groove may be inclined at a different angle relative to each other. In aspects of embodiments of the present invention, each of the sides 218A-218F and 224A-224F of said hexagonally shaped groove may have a different depth relative to each other side.

In an aspect of an embodiment of the present invention, any one or more of finger pockets 220A, 220B, 228A and 228B may further include one or more recessed pocket 230 (FIG. 2A).

In an aspect of an embodiment of the present invention, a climber/use of climb training device 200 may use a rope R to assist in the climber's training regimen by installing the rope through bore 216 of hole 212. The rope may then be hung, thereby hanging climb training device 200 for training.

Finger training may be made possible by having a climber insert his/her fingers into either of finger pockets 220A or 220B as shown in FIG. 2B. Climber training device 200 may first be hung from a stationary or stable position/post via rope, R, which may be threaded through bore 216 of hole 212. The climber may then hang from either or both of finger pockets 220A and 220B to enable the climber's finger training.

Additional finger training may be made possible by having a climber insert his/her fingers into section(s) of groove 224. In an aspect of an embodiment of the present invention, this may include inserting fingers into any one of the sides 224A-224F of hexagonally shaped groove 224 as shown in FIG. 2C. Finger strength training may be made possible with climb training device 200 being hung from a stationary or stable position/post via rope, R while the climber hangs onto climb training device 200 by way of groove 224.

Pinch training may be made possible by taking advantage of the different widths of climb training device 200 as a result of the device's tapering width sections which range from the widest width section 202A to the narrowest width section 202B. A climber, C, may be able to train with the different widths of climb training device 200 by gripping each width as he/she trains (see FIG. 2E).

Figure 3A:
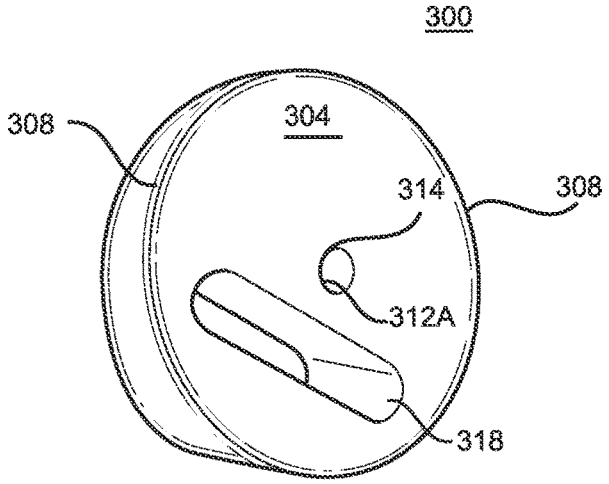
FIG. 3A illustrates a top perspective view of a climb training device according to an aspect of an embodiment of the present invention.
Figure 3B:
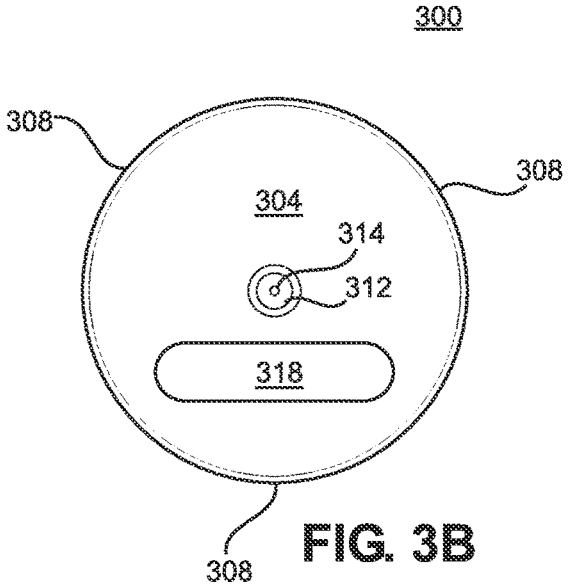
FIG. 3B illustrates a front view of a first base side of a climb training device according to an aspect of an embodiment of the present invention.
Figure 3C:
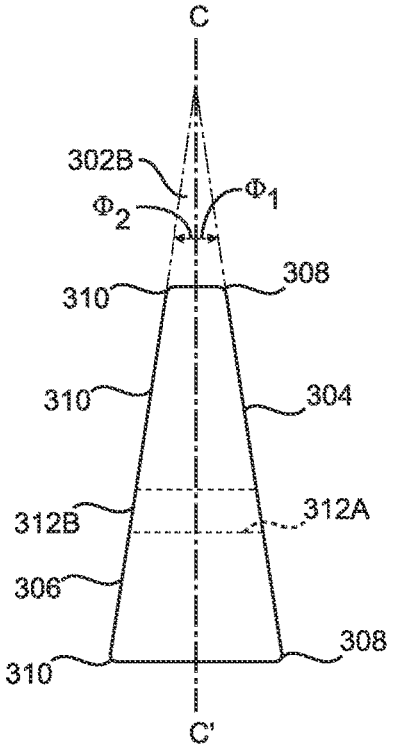
FIG. 3C illustrates a side view of a climb training device according to an aspect of an embodiment of the present invention.

Referring now to FIGS. 3A-3C, different views of climb training device 300 is illustrated according to another aspect of an embodiment of the present invention. Climb training device 300 may, in an aspect of an embodiment of the present invention, comprise of a solid cylindrical piece with uniform radius and tapering width, tapering from widest width section 302A to narrowest width section 302B. Climb training device 300 may also, in an aspect of an embodiment of the present invention, comprise of widest width section 302A and narrowest width section 302B.

Referring specifically to FIG. 3C, in an aspect of an embodiment of the present invention, climb training device 300, may comprise of first base side 304 which may be inclined at an angle, $\Phi_1$, to plane C-C' thereby effecting the tapering of climb training device 300 from wide width section 302A down to narrower width section 302B. In an aspect of an embodiment of the present invention, climb training device 300, may comprise of second base side 306 which may be inclined at an angle, Ø2, to plane C-C'. In another aspect of an embodiment of the present invention, second base side 306 may be inclined at the same angle, $\Phi_1$, to plane C-C' as with first base side 304. In another aspect of an embodiment of the present invention either of first base side 304 or second base side 306 may be inclined at an angle in relation to plane C-C'. In yet another aspect of an embodiment of the present invention, only one of first base side 304 or second base side 306 may be inclined at an angle in relation to plane C-C'. In another aspect of an embodiment of the present invention, at least one of the first base side 304 or the second base side 306, may be inclined at an angle to a plane passing through: (a) the midpoint of widest width section 302A and (b) the midpoint of narrowest width section 302B. Plane C-C', it should be noted may, in aspects of embodiments of the present invention, be parallel to any given horizontal plane.

In an aspect of an embodiment of the present invention, first base side 304 of climb training device 300 may comprise of periphery 308 while second base side 306 of climb training device 300 may comprise of periphery 310. Climb training device 300 may further comprise of hole 312 at center 314 of climb training device 300. Hole 312 may comprise of hole opening 312A on first base side 304 and hole opening 312B on second base side 306 with bore 316 connecting openings 314A and 314B. Bore 316 may serve as a receptacle for a climber looping rope, elastic cords etc. through climb training device 300 for the climber's training regimen.

In an aspect of an embodiment of the present invention, any one or both of: first base side 304 and second base side 306 may comprise of one or more finger pocket(s) 318.

Figure 4A:
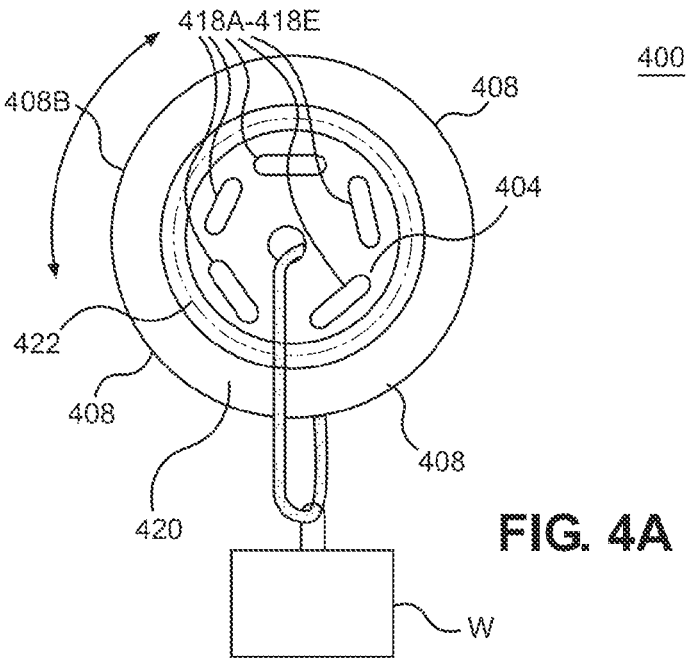
FIG. 4A illustrates a front view of another climb training device according to an aspect of an embodiment of the present invention.
Figure 4B:
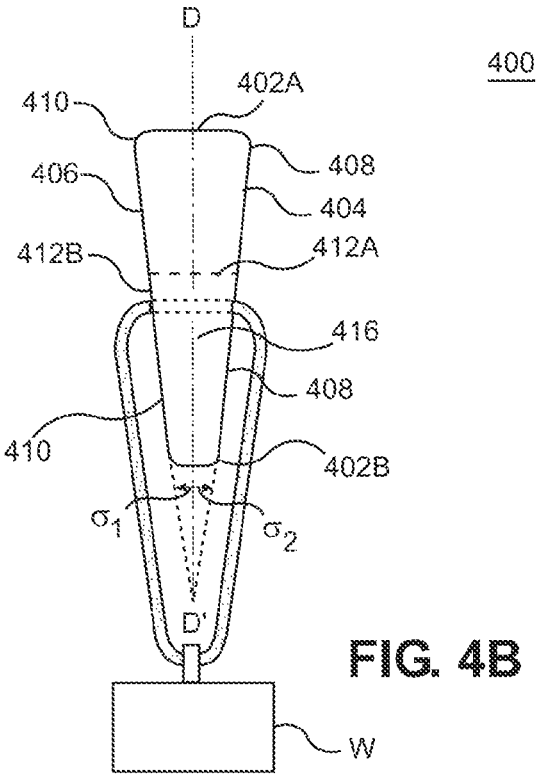
FIG. 4B illustrates a side view of another climb training device according to an aspect of an embodiment of the present invention.

Referring now to FIGS. 4A & 4B, front and side views of climb training device 400 are illustrated according to aspects of embodiments of the present invention. Climb training device 400 may be a solid cylindrical piece having a uniform radius and a tapering width, tapering from a wide width section 402A down to a narrower width section 402B. Climb training device 400 may also include a first base side 404 and a second base side 406 with first base side 404 having a periphery 408 and second base side 406 having a periphery 410. Climb training device 100 may also include a hole 412 located at climb training device 100's center 414, where hole 412 may include openings 412A and 412B respectively on first base side 404 and second base side 406. A bore 416 may connect openings 412A and 412B.

In an aspect of an embodiment of the present invention, first base side 404 and second base side 406 may be mirror images of one another in that they may have the same or similar structures, elements, characteristics etc. In another aspect of an embodiment of the present invention, first base side 404 and second base side 406 may differ from each other on the basis of their respective structures, elements, characteristics etc.

In an aspect of an embodiment of the present invention, climb training device 100 may include one or more finger pockets 418A-418E which may be, in one aspect of an embodiment of the present invention, positioned between 412 hole and periphery 408 or 410. It should be noted that depiction and disclosure of one or more finger pockets 418A-418E is illustrative only and not limiting as fewer or more finger pockets are also contemplated by aspects of embodiments of the present invention.

In an aspect of an embodiment of the present invention, each of finger pockets 418A-418E may have differing sizes from one another.

In an aspect of an embodiment of the present invention, each of finger pockets 418A-418E may also have different depths.

In an aspect of an embodiment of the present invention, first base side 404 of climb training device 100 may further include first pinch grip groove 420 and second pinch grip groove 422, where second pinch grip groove 422, in an aspect of an embodiment of the present invention, may be positioned between periphery 408 and hole 412, and where first pinch grip groove 420 may be positioned between periphery 408 and second pinch grip groove 422.

In an aspect of an embodiment of the present invention, first pinch grip groove 420 and second pinch grip groove 422 may both be concentric grooves around hole 412.

In an aspect of an embodiment of the present invention, first pinch grip groove 420 may comprise of a smooth surface, while second pinch grip groove 422, in another aspect of an embodiment of the present invention, may comprise of a surface with different textures.

Referring specifically to FIG. 4B, in an aspect of an embodiment of the present invention, climb training device 400, may comprise of first base side 404 which may be inclined at an angle, $\sigma_1$, to plane D-D' thereby effecting the tapering of climb training device 400 from widest width section 402A down to narrowest width section 402B. In an aspect of an embodiment of the present invention, climb training device 400, may comprise of second base side 406 which may be inclined at an angle, $\sigma_2$, to plane D-D'. In another aspect of an embodiment of the present invention, second base side 406 may be inclined at the same angle, $\sigma_1$, to plane D-D' as with first base side 404. In another aspect of an embodiment of the present invention either of first base side 404 or second base side 406 may be inclined at an angle in relation to plane D-D'. In yet another aspect of an embodiment of the present invention, only one of first base side 404 or second base side 406 may be inclined at an angle in relation to plane D-D'. In another aspect of an embodiment of the present invention, at least one of the first base side 404 or the second base side 406, may be inclined at an angle to a plane passing through: (a) the midpoint of widest width section 302A and (b) the midpoint of narrowest width section 302B. Plane D-D', it should be noted may, in aspects of embodiments of the present invention, be parallel to any given horizontal plane.

Referring now to FIGS. 5A-5E, views showing different uses of climb training device 500, are shown according to aspects of embodiments of the present invention. It should be noted that climb training device 500 as shown in FIGS. 5A-5F is illustrative only as it represents climb training devices 200, 300 and 400. It may also represent climb training device 100 when both detachable sections 102 and 104 are used jointly as a combined device using assembly elements.

As shown, a climber, C, may train using climb training device 500 using weights, W, elastic bands, E, and or rope, R. As shown, climber, C may conduct pinch training by hanging weight, W from rope, R and utilizing pockets 502A-502C (similar use as with pockets 132A-132D, 134A-134D, 220A-220B, 228A-228B, 318, 418A-418E) and/or pinch width variety around the circumference of climb training device 500 ranging from widest width section 504A to narrowest width section 504B. Because climbing training device 500 is illustrative and representative of climb training devices 100, 200, 300 and 400, use of pockets 502A-502C as described here extends also to pockets 132A-132D, 134A-134D, 220A-220B, 228A-228B, 318, and 418A-418E.

Figure 5A:
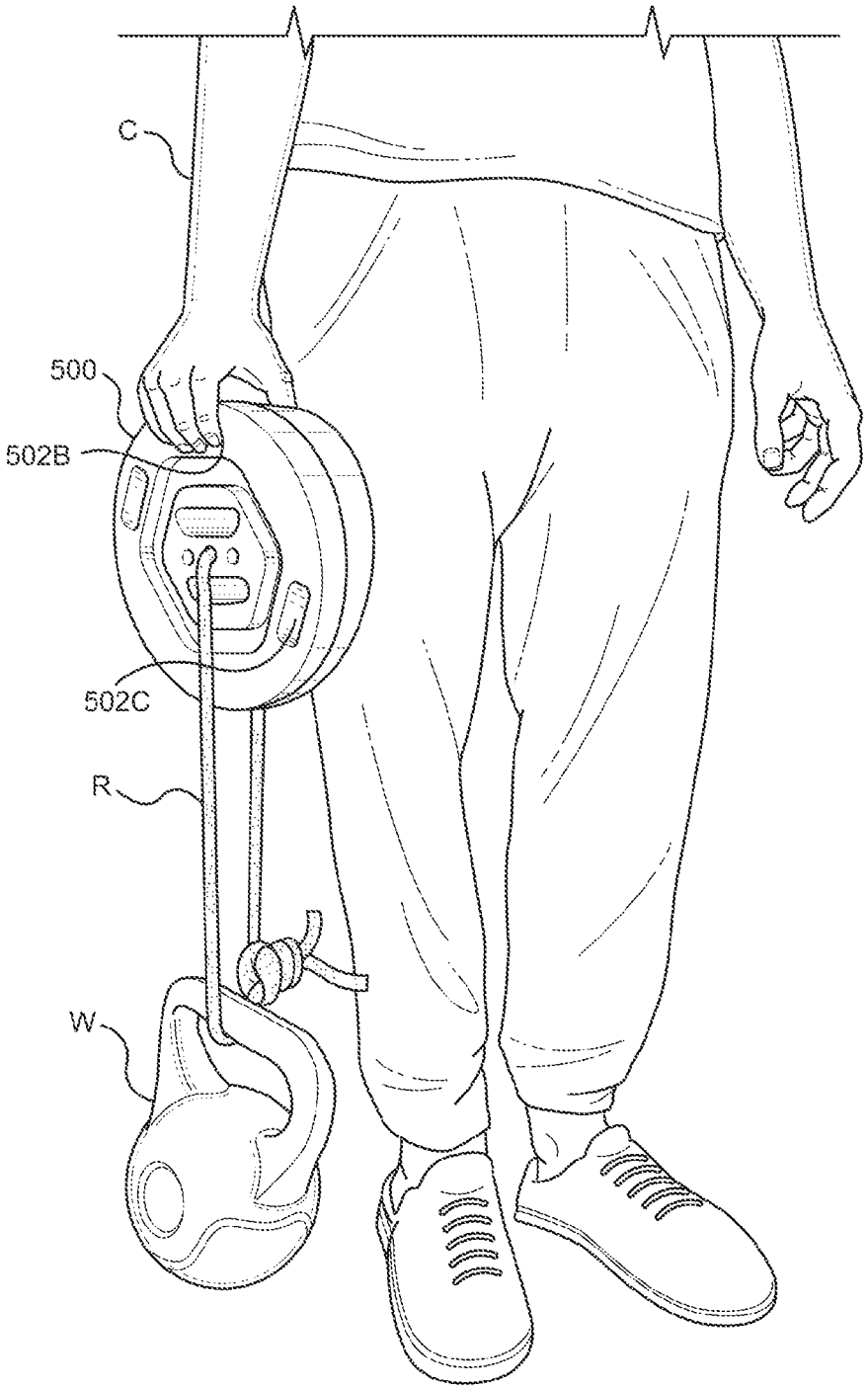
FIGS. 5A through 5E illustrate views showing different uses of a climb training device according to aspects of embodiments of the present invention.
Figure 5B:
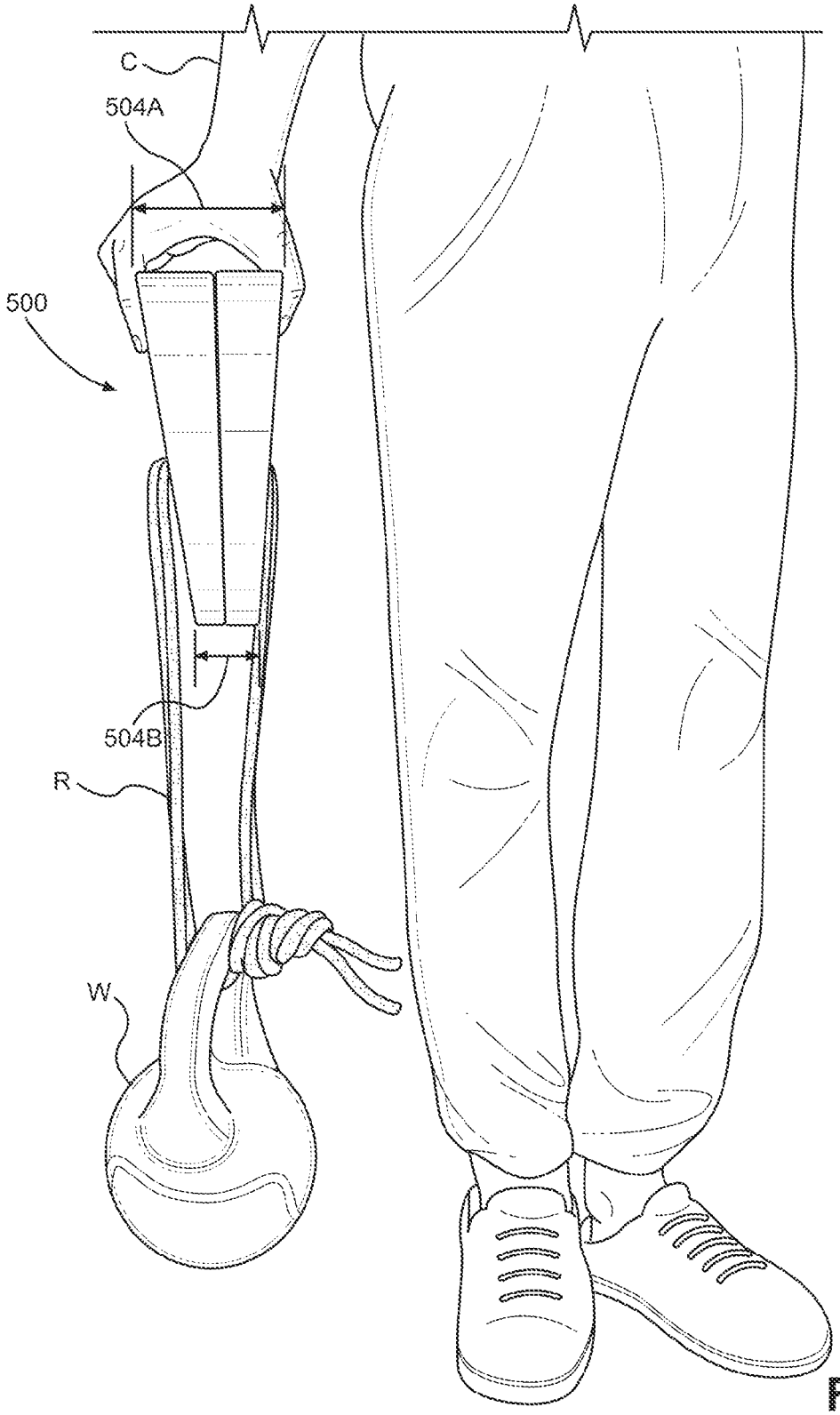
Figure 5C:
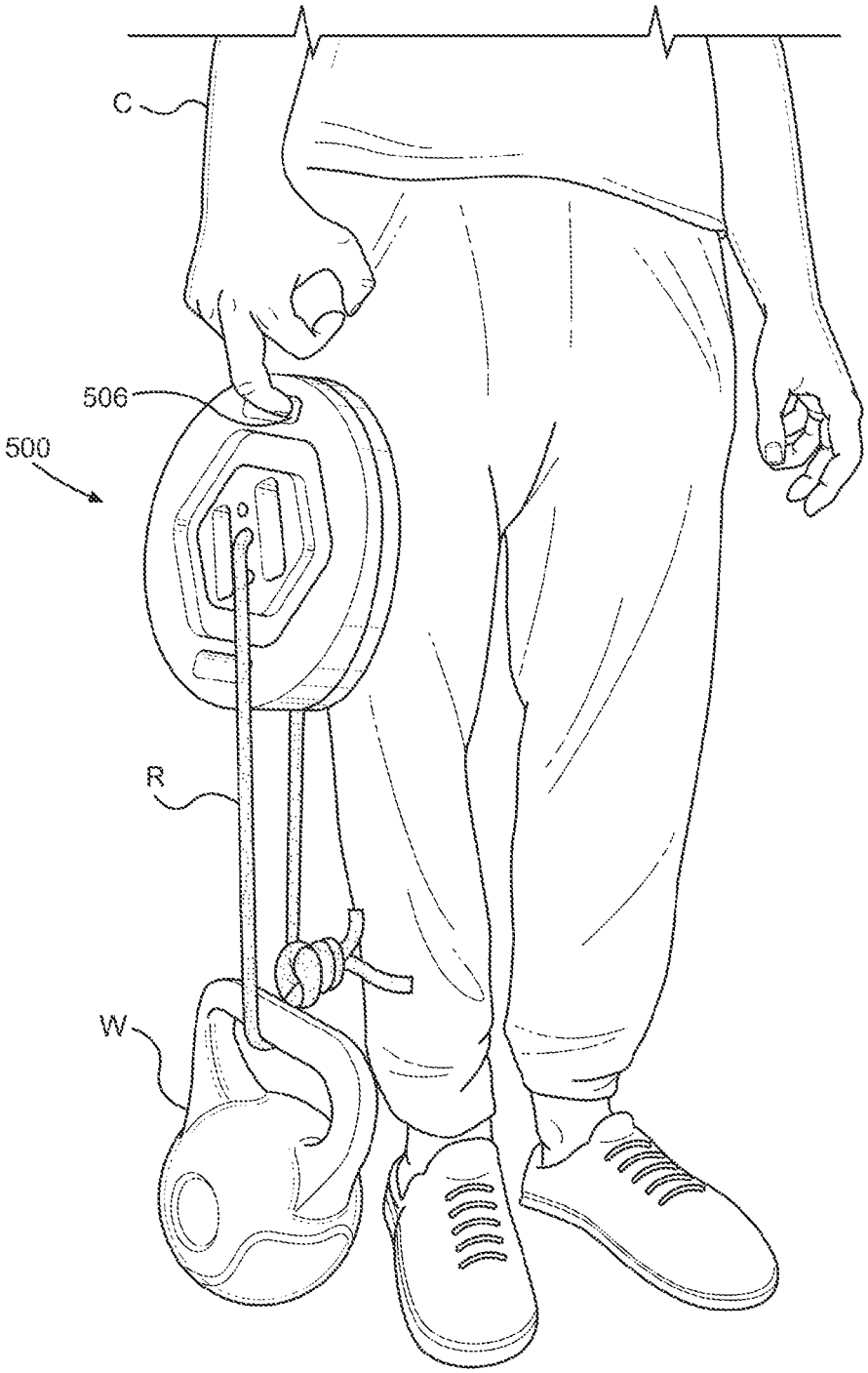
Figure 5D:
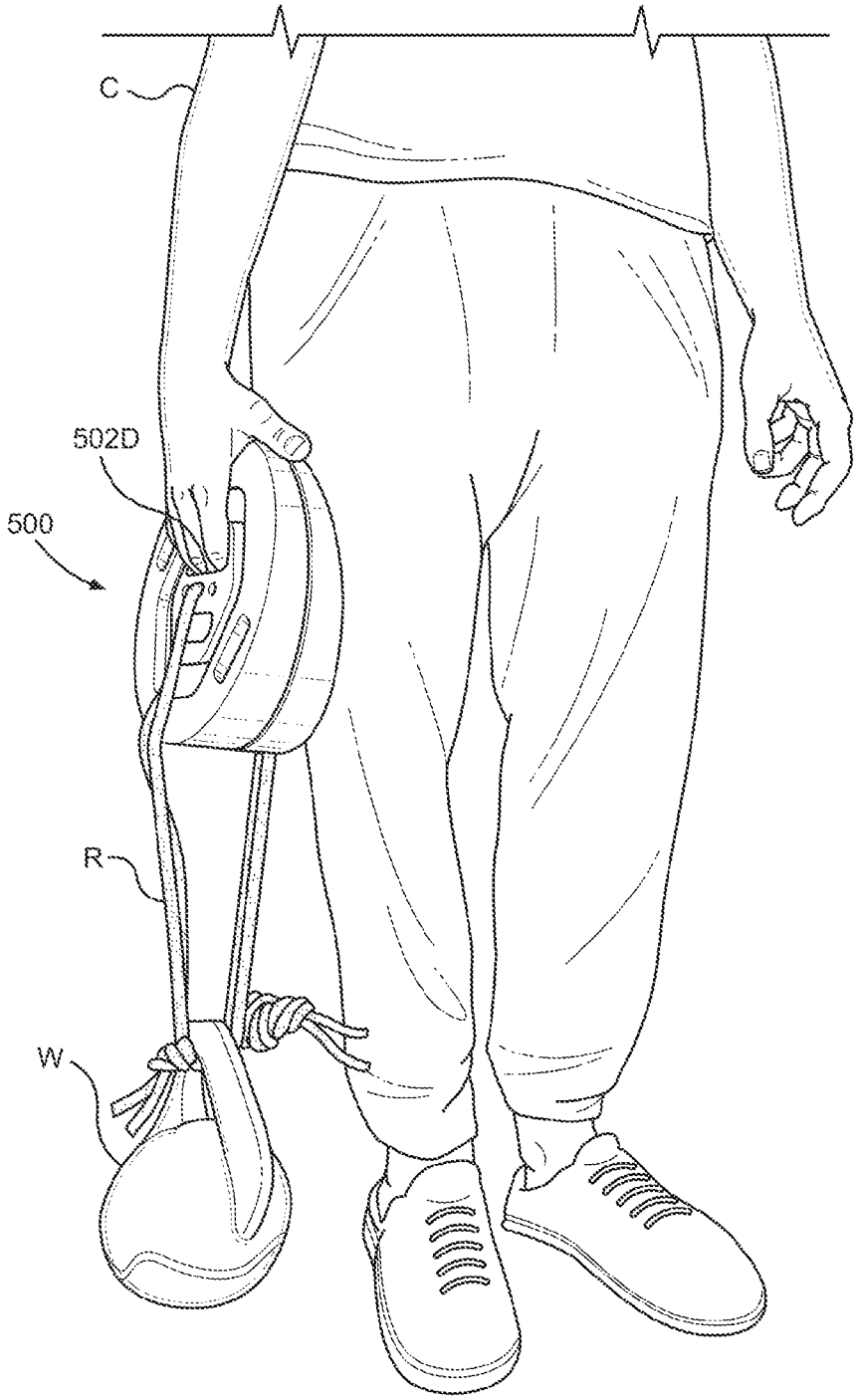

Climber, C may also conduct finger training by inserting finger(s) into recessed pocket(s) 506 (similar use/situation as with recessed pockets 136A-136B, 138A-138B, 230), whilst hanging weight, W, from climb training device 500 by way of rope, R (FIG. 5C). In an aspect of an embodiment of the present invention, recess pocket(s) 506 may have different depths, widths and/or dimensions to accommodate training for four fingers as well as for three, two or one finger training. Additional finger training may be made possible by having climber, C, insert his four fingers into pocket 502D (similar use/situation as with pockets 132A-132D, 134A-134D, 220A-220B, 228A-228B, 318, 418A-418E), while climb training device 500 has weight, W, hung from it by way of rope, R (FIG. 5D).

Figure 5E:
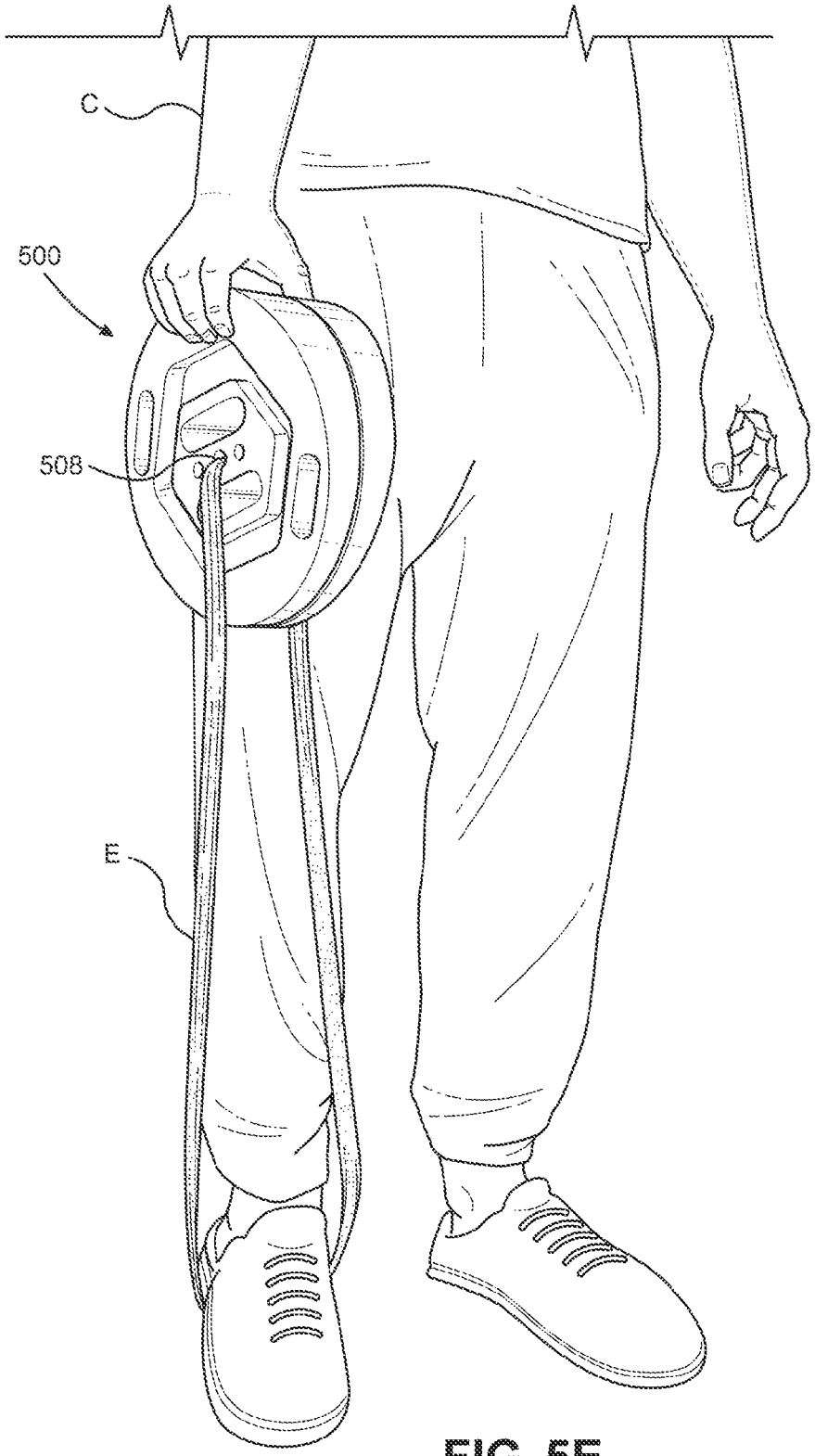

Climber, C may also conduct pinch or finger training may using elastic bands/cords threaded through bore 508 of climb training device 500 (similar use/situation as with bores 118, 128, 216, 316, 416) while looping the tied elastic band under climber C's foot and pulling or lifting climb training device 500 (FIG. 5E).

Although this present invention has been disclosed with reference to specific forms and embodiments, it will be evident that a great number of variations may be made without departing from the spirit and scope of the present invention. For example, parts or elements may be rearranged, equivalent elements may be substituted for those specifically disclosed and certain features of the present invention may be used independently of other features—all without departing from the present invention as outlined above, in the appended figures and the claims presented below. These and other changes and variations which are obvious to those skilled in the art are intended to be included within the scope of the present invention.

What is claimed is:

1. A climb training device, comprising:

a solid cylindrical piece with uniform radius and overall tapering width, having first and second base sides, each base sides having a periphery wherein said solid cylindrical piece comprises of a widest width section and a narrowest width section wherein said solid cylindrical piece tapers from said widest width section to said narrowest width section; and a hole at said cylindrical piece's center, wherein said hole comprises of openings on said first and second base sides and a bore connecting said openings;

wherein said first base side comprises of a contiguous groove, said contiguous groove positioned between said hole opening on said first base side and said first base side's periphery, wherein said first base side comprises of at least one finger pocket located between said contiguous groove and said first base side's periphery, wherein said first base side comprises of an island surrounded by said contiguous groove;

wherein said second base side comprises of a contiguous groove, said contiguous groove positioned between said hole opening on said second base side and said second base's periphery, wherein said second base side comprises of an island surrounded by said contiguous groove.

2. The climb training device of claim 1, wherein said island of said second base side comprises of at least one finger pocket.

3. The climb training device of claim 1, wherein at least one of said contiguous groove of said first base side and said contiguous groove of said second base side is a hexagonally shaped groove.

4. The climb training device of claim 3, wherein each side of said hexagonally shaped groove is inclined at a different angle relative to each other.

5. The climb training device of claim 3, wherein each side of said hexagonally shaped groove is of a different depth.

6. The climb training device of claim 1, wherein said at least one finger pocket comprises of: at least one recessed pocket, at least one hole.

7. The climb training device of claim 1, wherein at least one of: said first base side or second base side is inclined at an angle to a plane passing through said widest width section's midpoint and said narrowest width section's midpoint.

8. A climb training device, comprising:

a solid cylindrical piece with uniform radius and overall tapering width, having first and second base sides, each base sides having a periphery, wherein said solid cylindrical piece comprises of a widest width section and a narrowest width section wherein said solid cylindrical piece tapers from said widest width section to said narrowest width section; and a hole at said cylindrical piece's center, wherein said hole comprises of openings on said first and second base sides and a bore connecting said openings;

wherein any one or both of: said first base side and second base side comprises of at least one finger pocket.

9. The climb training device of claim 8, wherein said at least one finger pocket is positioned between said hole of any one or both of: said first base side, second base side and said periphery of corresponding base side of any one or both of: said first base side, second base side.

10. The climb training device of claim 8, wherein said at least one finger pocket are characterized by any one or more of: different sizes or different depths in relation to one another.

11. The climb training device of claim 8, further comprising of first pinch grip groove and second pinch grip groove, wherein said second pinch grip groove is positioned between said periphery and said hole, and wherein said first pinch grip groove is positioned between said periphery and said second pinch grip groove.

12. The climb training device of claim 11, wherein said first pinch grip groove and said second pinch grip groove are both concentric grooves around said hole.

13. The climb training device of claim 8, wherein at least one of: said first base side or second base side is inclined at an angle to a plane passing through said widest width section's midpoint and said narrowest width section's midpoint.

14. A climb training device, comprising:

a first detachable cylindrical section, comprising of first and second base sides; and a second detachable cylindrical section, comprising of first and second base sides, wherein each of said first detachable cylindrical section and a second detachable cylindrical section comprises of a uniform radius and an overall tapering width, wherein each of said first and second detachable cylindrical sections comprises of a widest width section and a narrowest width section wherein said first detachable cylindrical section tapers from said widest width section of said first detachable cylindrical section to said narrowest width section of said first detachable cylindrical section, wherein said second detachable cylindrical section tapers from said widest width section of said second detachable cylindrical section to said narrowest width section of said second detachable cylindrical section, wherein said second detachable cylindrical section comprises of at least one bore for connection with said first detachable cylindrical section, wherein said first detachable cylindrical section comprises of at least one dowel adapted to connect with said at least one bore of said second detachable cylindrical section, and wherein each of said first detachable cylindrical section and a second detachable cylindrical section comprises of a hole at each of said section's center, wherein said hole comprises of openings on said first and second base sides of each respective section and a bore connecting said openings.

15. The climb training device of claim 14, wherein said first detachable cylindrical section and a second detachable cylindrical section each comprise of a periphery.

16. The climb training device of claim 15, wherein any one or both of: said first detachable cylindrical section and a second detachable cylindrical section comprises of at least one finger pocket positioned between said hole of each section and said periphery of said section.

17. The climb training device of claim 14, wherein both first detachable cylindrical section and second detachable cylindrical section comprise of a variety of different recessed finger pockets on each respective first side of each section.

18. The climb training device of claim 14, wherein both first detachable cylindrical section and second detachable cylindrical section comprise of a contiguous groove around said respective hole on each respective first side of each section.

19. The climb training device of claim 14, wherein at least one of: first base side of first detachable cylindrical section or first base side of second detachable cylindrical section is inclined at an angle to a plane parallel to one of: second base side of first detachable cylindrical section or second base side of second detachable cylindrical section.

20. The climb training device of claim 14, wherein said at least one of: first base side of first detachable cylindrical section or first base side of second detachable cylindrical section is inclined at an angle to a plane passing through midpoint of: (a) combined width of widest width sections of first detachable cylindrical section and second detachable cylindrical section and (b) combined width of narrowest width sections of first detachable cylindrical section and second detachable cylindrical section.

* * * * *